US010927508B2

(12) United States Patent
Vogt et al.

(10) Patent No.: US 10,927,508 B2
(45) **Date of Patent: *Feb. 23, 2021**

(54) PAPERMAKING FABRICS HAVING MACHINE AND CROSS-MACHINE DIRECTION ELEMENTS AND PAPER PRODUCTS MADE THEREWITH

(71) Applicant: Kimberly-Clark Worldwide, Inc., Neenah, WI (US)

(72) Inventors: Kevin Joseph Vogt, Neenah, WI (US); Mark Alan Burazin, Oshkosh, WI (US); Mike Thomas Goulet, Neenah, WI (US); Richard Allen Zanon, Appleton, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 124 days.

This patent is subject to a terminal disclaimer.

(21) Appl. No.: 16/205,343

(22) Filed: Nov. 30, 2018

(65) Prior Publication Data

US 2020/0173114 A1 Jun. 4, 2020

(51) Int. Cl.

| | |
|---|---|
| ***D21H 27/02*** | (2006.01) |
| ***D21H 27/00*** | (2006.01) |
| ***A47K 10/16*** | (2006.01) |

(52) U.S. Cl.

CPC ..... *D21H 27/005* (2013.01); *A47K 10/16* (2013.01); *D21H 27/02* (2013.01)

(58) Field of Classification Search

USPC ..... 162/116

See application file for complete search history.

(56) References Cited

U.S. PATENT DOCUMENTS

| | | | | |
|---|---|---|---|---|
| 6,398,910 | B1 | 6/2002 | Burazin et al. | |
| 7,935,409 | B2 | 5/2011 | Burazin et al. | |
| 9,512,572 | B2 * | 12/2016 | Weaver | D21H 25/005 |
| 2003/0106657 | A1 | 6/2003 | Baggot | |
| 2015/0247290 | A1 * | 9/2015 | Burazin | A47K 10/16 162/123 |
| 2018/0298560 | A1 * | 10/2018 | Burazin | D21H 27/004 |

OTHER PUBLICATIONS

Co-pending U.S. Appl. No. 16/205,340, filed Nov. 30, 2018, by Vogt et al. for "Papermaking Fabrics Having Machine and Cross-Machine Direction Elements and Paper Products Made Therewith."

Co-pending U.S. Appl. No. 16/205,355, filed Nov. 30, 2018, by Zanon et al. for "Papermaking Fabrics Having Machine and Cross-Machine Direction Elements and Paper Products Made Therewith."

* cited by examiner

*Primary Examiner* — Mark Halpern

(74) *Attorney, Agent, or Firm* — Kimberly-Clark Worldwide, Inc.

(57) ABSTRACT

The present invention discloses tissue products, specifically rolled bath tissue products, having a three-dimensional surface topography comprising substantially continuous machine direction (MD) oriented elements, discrete cross-machine direction (CD) oriented elements and discrete MD oriented valleys having valley sidewalls formed by the MD oriented elements and valley endwalls formed by the CD oriented elements. The discrete valleys generally have a length greater than about 10.0 mm. The CD oriented elements comprise a relatively small percentage of the tissue surface area, such as less than about 15 percent, yet the tissue products display good anti-nesting properties when spirally wound into rolls, such as a Roll Structure greater than about 0.75.

17 Claims, 11 Drawing Sheets

PAPERMAKING FABRICS HAVING MACHINE AND CROSS-MACHINE DIRECTION ELEMENTS AND PAPER PRODUCTS MADE THEREWITH

BACKGROUND

For rolled tissue products, such as bathroom tissue and paper towels, consumers generally prefer firm rolls having a large diameter. A firm roll conveys superior product quality and a large diameter conveys sufficient material to provide value for the consumer. From the standpoint of the tissue manufacturer, however, providing a firm roll having a large diameter is a challenge. In order to provide a large diameter roll, while maintaining an acceptable cost of manufacture, the tissue manufacturer must produce a finished tissue roll having higher roll bulk. One means of increasing roll bulk is to wind the tissue roll loosely. Loosely wound rolls however, have low firmness and are easily deformed, which makes them unappealing to consumers. As such, there is a need for tissue rolls having high bulk as well as good firmness.

Furthermore, it is desirable to provide a rolled tissue product having a high basis weight tissue sheet that is also soft. To provide a tissue product that is perceived as being soft, the tissue manufacturer is faced with a myriad of choices, including altering the surface topography of the tissue product so that the user perceives it as being smooth. Smooth, high basis weight products however, are difficult to wind into firm, high bulk finished products.

The challenge of balancing bulk, firmness, and sheet smoothness is particularly acute when winding through-air dried tissue products since much of the product bulk is achieved by molding the embryonic tissue web into the papermaking fabric which is increasingly difficult at higher basis weights and the molded structure may need to be calendered to increase sheet smoothness. Hence the tissue manufacturer must strive to economically produce a tissue roll that meets these often-contradictory parameters of high bulk, firm and smooth tissue products at an acceptable cost.

SUMMARY

It has now been discovered that certain consumer preferred properties of tissue products, including through-air dried tissue products, can be improved by modifying the fabrics used in the process of manufacturing the tissue product. The resulting tissue products, particularly rolled tissue products, have both a high degree of bulk and firmness, particularly for rolls made from relatively soft sheets.

Accordingly, in one embodiment the present invention provides a papermaking fabric, particularly a through-air drying fabric, comprising a plurality of interwoven shute and warp filaments, the fabric having a web contacting surface and an opposite machine contacting surface, the web contacting surface comprising a plurality of spaced apart machine direction (MD) oriented protuberances defining a plurality of valleys there between, the valleys having a valley bottom surface plane and a plurality of cross-machine direction (CD) oriented protuberances, wherein the MD and CD oriented protuberances have an upper surface that lies above the valley bottom surface plane. In certain preferred embodiments the MD oriented protuberances may be formed by the interwoven shute and warp filaments and may extend substantially continuously along the machine direction of the fabric. The CD oriented protuberances, on the other hand, may be non-woven and discrete. In certain embodiments the discrete, nonwoven CD oriented protuberances may have a length from about 2.0 to about 15 mm, such as from about 3.0 to about 10.0 mm, and more preferably from about 5.0 to about 8.0 mm.

In another embodiment the present invention provides a papermaking fabric having a web contacting surface and an opposed machine contacting surface, the web contacting surface comprising a plurality of discrete CD oriented protuberances having a length from about 2.0 to about 15 mm, such as from about 3.0 to about 10.0 mm, and more preferably from about 5.0 to about 8.0 mm and an element angle from about 20 to about 45 degrees, wherein the CD oriented protuberances cover less than about 15 percent of the web contacting surface of the fabric. In a particularly preferred embodiment the fabric further comprises a plurality of MD oriented protuberances arranged substantially parallel to one another and spaced apart a distance (D1) and the length of the CD oriented protuberances is less than 3 times D1. For example, in certain preferred embodiments the MD oriented protuberances may be spaced apart from each other a distance of about 2.0 mm or greater, such as from about 2.0 to about 5.0 mm and the CD oriented protuberances may have a length of about 5.0 mm or greater, such as from about 5.0 to about 15 mm.

In another embodiment the present invention provides a tissue product having a three-dimensional surface topography comprising a plurality of MD oriented elements, such as ridges, separated from one another by a plurality of MD oriented valleys, wherein at least a portion of the MD oriented valleys are discontinuous. The discontinuous MD oriented valleys may have a length of about 10 mm or greater, such as about 15 mm or greater, such as about 20 mm or greater, such as from about 10 to about 30 mm, such as from about 15 to about 30 mm, such as from about 20 to about 30 mm.

In yet other embodiments the present invention provides a tissue product having a fabric side and an opposed air side, wherein the air side comprises MD and CD oriented elements having upper surface planes lying above the lowest surface plane of the air side. In particularly preferred embodiments the MD oriented elements are substantially continuous and the CD oriented elements are discrete and both elements have a height, generally measured as the z-directional distance between the uppermost surface plane of the element and the lowermost surface plane of the product, of at least about 300 μm.

In another embodiment the present invention provides a method of making a through-air dried tissue sheet comprising (a) depositing an aqueous suspension of papermaking fibers onto a forming fabric to form a wet web; (b) dewatering the wet web to yield a partially dewatered web having a consistency from about 20 to about 30 percent; (c) transferring the partially dewatered web to a through-air drying fabric having a plurality of interwoven shute and warp filaments, the fabric having a web contacting surface and an opposite machine contacting surface, the web contacting surface comprising a plurality of spaced apart machine direction (MD) oriented protuberances defining a plurality of valleys having a valley bottom surface plane there between, and a plurality of cross-machine direction (CD) oriented protuberances, wherein the MD and CD oriented protuberances have an upper surface that lies above the valley bottom surface plane, wherein the web is macroscopically rearranged to conform to the surface of the through-air drying fabric; and (e) through-air drying the web to yield a through-air dried tissue web.

In other embodiments the present invention provides a rolled bath product comprising a single-ply bath tissue spirally wound about a core, the rolled product having a geometric mean tensile (GMT) strength less than about 1,000 g/3", a sheet bulk greater than about 12 cc/g, a roll bulk greater than about 10 cc/g and a roll firmness greater than about 6.0 mm.

In still other embodiments the present invention provides a rolled paper towel comprising a single-ply paper towel spirally wound about a core, the rolled product having a geometric mean tensile (GMT) strength greater than about 1,500 g/3", a sheet bulk greater than about 16 cc/g, a roll bulk greater than about 15 cc/g and a roll firmness greater than about 6.0 mm.

In yet other embodiments the present invention provides a rolled paper towel comprising a multi-ply paper towel spirally wound about a core, the rolled paper towel product having a geometric mean tensile (GMT) strength greater than about 2,000 g/3", a sheet bulk greater than about 16 cc/g, a roll bulk greater than about 15 cc/g and a roll firmness greater than about 6.0 mm.

DEFINITIONS

Figure 1:
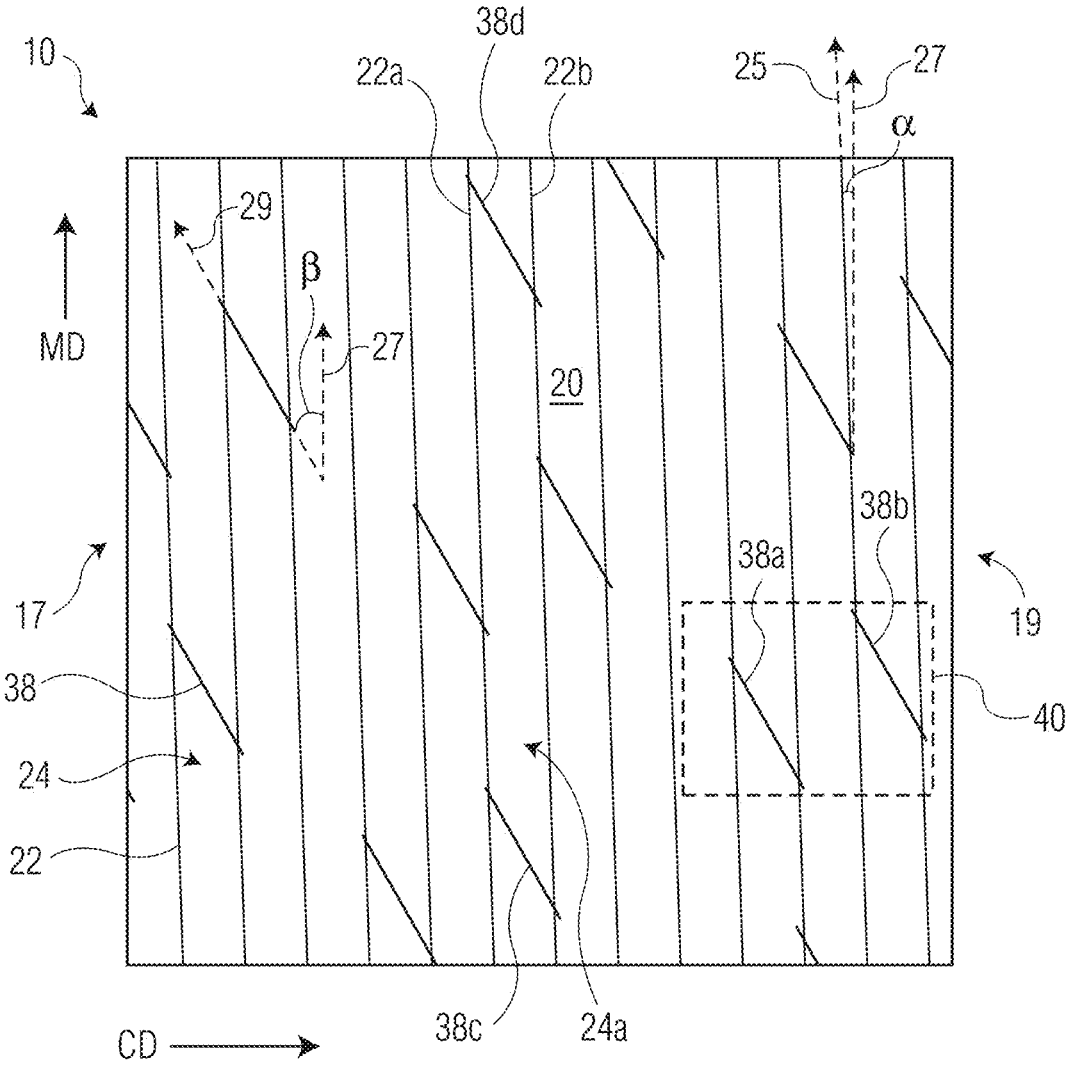
FIG. 1 is top plan view of a papermaking fabric according to one embodiment of the present invention.

As used herein, a "tissue product" generally refers to various fibrous structures, particularly sheets of fibrous material that may be spirally wound about a core, such as facial tissue, bath tissue, paper towels, napkins, and the like.

As used herein, the term "basis weight" generally refers to the bone dry weight per unit area of a tissue and is generally expressed as grams per square meter (gsm). Basis weight is measured using TAPPI test method T-220. Normally, the basis weight of a tissue product of the present invention is greater than about 10 grams per square meter (gsm), such as from about 10 to about 80 gsm.

As used herein, the term "ply" refers to a discrete element of a tissue product. Individual plies may be arranged in juxtaposition to each other. The term may refer to a plurality of web-like components such as in a multi-ply facial tissue, multi-ply bath tissue, multi-ply paper towel, multi-ply wipe, or multi-ply napkin, which may comprise two, three, four or more individual plies arranged in juxtaposition to each other where one or more plies may be attached to one another such as by mechanical or chemical means.

As used herein, the term "layer" refers to a plurality of strata of fibers, chemical treatments, or the like, within a ply.

As used herein, the terms "layered tissue web" "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries upon one or more endless foraminous screens. If the individual layers are initially formed on separate foraminous screens, the layers are subsequently combined (while wet) to form a layered composite web.

As used herein, the term "papermaking fabric" means any fabric useful in the manufacture of a fibrous structure, such as a tissue sheet, either by a wet-laid process or an air-laid process. Specific papermaking fabrics within the scope of this invention include forming fabrics; transfer fabrics conveying a wet web from one papermaking step to another, such as described in U.S. Pat. No. 5,672,248; as molding, shaping, or impression fabrics where the web is conformed to the structure through pressure assistance and conveyed to another process step, as described in U.S. Pat. No. 6,287,426; as creping fabrics as described in U.S. Pat. No. 8,394,236; as embossing fabrics as described in U.S. Pat. No. 4,849,054; as a structured fabric adjacent a wet web in a nip as described in U.S. Pat. No. 7,476,293; or as a through-air drying fabric as described in U.S. Pat. Nos. 5,429,686, 6,808,599 and 6,039,838. The fabrics of the invention are also suitable for use as molding or air-laid forming fabrics used in the manufacture of non-woven, non-cellulosic webs such as baby wipes.

As used herein, the "fabric side" of the tissue sheet is the side of the sheet brought into facing contact with the papermaking fabric of the present invention during manufacture and the "air side" of the sheet is the side facing away from the papermaking fabric. For example, in through-air drying processes the "fabric side" of the tissue sheet contacts the through-air drying fabric as it is conveyed over the through-air dryer and the "air side" of the sheet faces away from the through-air drying fabric. When the sheet is wound into a roll of product by winding the sheet concentrically about a core it is often preferred that the sheet is wound such that the air side of the sheet faces inwardly towards the core and the fabric side of the sheet faces outwardly towards the consumer.

As used herein the term "machine direction" (MD) generally refers to the direction in which a tissue web or product is produced. The term "cross-machine direction" (CD) refers to the direction perpendicular to the machine direction.

As used herein the term "machine direction oriented" when referring to a protuberance on a papermaking fabric or an element disposed on the surface of a tissue ply or product generally means that the element or protuberance's principle axis of orientation is positioned at an angle of less than about 20 degrees relative to the machine direction (MD) axis of the fabric or tissue sheet.

As used herein the term "cross-machine direction oriented" when referring to a protuberance on a papermaking fabric or an element disposed on the surface of a tissue ply or product generally means that the element or protuberance's principle axis of orientation is positioned at an angle of greater than about 20 degrees relative to the machine direction (MD) axis of the fabric or tissue sheet. For example, a discrete, nonwoven protuberance disposed on the web contacting surface of a papermaking fabric having an element angle greater than 20 degrees, such as from 20 to about 40 degrees, may be said to be cross-machine direction oriented.

As used herein, the term "protuberance" generally refers to a three-dimensional element disposed on the web contacting surface of a papermaking fabric. For example, in one embodiment, a protuberance may be formed by one or more warp filaments overlaying a plurality of shute filaments. In other instances a protuberance may be a nonwoven material disposed on the web contacting surface of the fabric.

As used herein, the term "valley" generally refers to a portion of a papermaking fabric or a tissue sheet that lies below the uppermost surface plane of the fabric or sheet and is generally bounded by a pair of protuberances in the case of a fabric valley, or a pair of elements, in the case of a sheet valley.

As used herein, the "valley bottom" generally refers to the lowest surface plane of a fabric or a tissue sheet. The valley bottom of a papermaking fabric is generally defined by the top of the lowest visible filament which a tissue web can contact when molding into the textured fabric and may be a warp knuckle, a shute knuckle, or both. The "valley bottom plane" is the z-direction plane intersecting the top of the elements comprising the valley bottom.

As used herein, the term "valley depth" when referring to a valley of a papermaking fabric generally refers to z-directional depth of a given valley. Papermaking fabrics prepared according to the present invention may have relatively deep valleys, such as valleys having valley depths greater than about 0.30 mm, more preferably greater than about 0.35 mm and still more preferably greater than about 0.40 mm, such as from about 0.30 to about 1.0 mm. Valley depth of a fabric may be measured by profilometry as the difference between C2 (95 percentile height) and C1 (5 percentile height) values, having units of millimeters (mm). In certain instances valley depth may be referred to as S90. To determine valley depth a profilometry scan of a fabric is generated as described herein, from which a histogram of the measured heights is generated, and an S90 value (95 percentile height (C2) minus the 5 percentile height (C1), expressed in units of mm) is calculated.

As used herein, the term "valley width" when referring to a valley of a papermaking fabric generally refers to the width of a valley disposed on a fabric according to the present invention. Generally valley width is measured along a line drawn normal to the machine direction axis of the fabric that intersects at least two adjacent MD oriented protuberances. The valley width of a given fabric may vary depending on the weave pattern, however, in certain instances the valley width may be greater than about 1.0 mm, more preferably greater than about 1.5 mm and still more preferably greater than about 2.0 mm, such as from about 2.0 to about 5.0 mm.

As used herein, the term "element angle" when referring to a protuberance disposed on the web contacting surface of a papermaking fabric or an element disposed on the air side of a tissue sheet is the orientation of the protuberance or element along its longitudinal axis relative to the MD axis of the fabric or tissue sheet. The element angle of a papermaking fabric protuberance may be measured by profilometry and described in the Test Method section below, or alternatively by microscopy as described in the Test Method section below. The element angle of an element disposed on a tissue sheet is preferably measured by microscopy as described in the Test Method section below.

As used herein, the term "caliper" is the representative thickness of a single sheet (caliper of tissue products comprising one or more plies is the thickness of a single sheet of tissue product comprising all plies) measured in accordance with TAPPI test method T402 using a ProGage 500 Thickness Tester (Thwing-Albert Instrument Company, West Berlin, N.J.). The micrometer has an anvil diameter of 2.22 inches (56.4 mm) and an anvil pressure of 132 grams per square inch (per 6.45 square centimeters) (2.0 kPa).

As used herein, the term "sheet bulk" refers to the quotient of the caliper (μm) divided by the bone dry basis weight generally expressed as grams per square meter (gsm). The resulting sheet bulk is expressed in cubic centimeters per gram (cc/g). Tissue products prepared according to the present invention may, in certain embodiments, have a sheet bulk greater than about 12 cc/g, more preferably greater than about 15 cc/g and still more preferably greater than about 17 cc/g.

As used herein, the term "roll bulk" refers to the volume of paper divided by its mass on the wound roll. Roll Bulk is calculated by multiplying pi (3.142) by the quantity obtained by calculating the difference of the roll diameter squared (having units of centimeters squared) and the outer core diameter squared (having units of centimeters squared) divided by 4, divided by the quantity sheet length (having units of centimeters) multiplied by the sheet count multiplied by the bone dry basis weight of the sheet (having units of grams per square meter).

As used herein, the term "roll firmness" or simply "firmness" generally refers to Kershaw Firmness, which is measured using the Kershaw Test as described in detail in U.S. Pat. No. 6,077,590, which is incorporated herein by reference in a manner consistent with the present disclosure. The apparatus is available from Kershaw Instrumentation, Inc. (Swedesboro, N.J.) and is known as a Model RDT-2002 Roll Density Tester.

As used herein, the term "roll structure" generally refers to the overall appearance and quality of a rolled tissue product and is the product of roll bulk (having units of cc/g) and caliper (having units of cm) divided by Firmness (having units of cm). Roll structure is generally referred to herein without reference to units.

As used herein, the term "slope" refers to slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width.

As used herein, the term "geometric mean slope" (GM Slope) generally refers to the square root of the product of machine direction slope and cross-machine direction slope. While the GM Slope may vary amongst tissue products prepared according to the present disclosure, however, in certain instances paper towel products may have a GMT greater than about 1,500 g/3" and a GM Slope less than about 14,000 g, more preferably less than about 13,000 g and still more preferably less than about 12,000 g, such as from about 7,000 to about 14,000 g. In other instances, bath tissue products may have a GMT less than about 1,000 g/3" and a GM Slope less than about 8,000 g, more preferably less than about 7,000 g and still more preferably less than about 6,000 g, such as from about 4,000 to about 8,000 g.

As used herein, the term "geometric mean tensile" (GMT) refers to the square root of the product of the machine direction tensile strength and the cross-machine direction tensile strength of the web. While the GMT may vary, paper towel products prepared according to the present disclosure may, in certain embodiments, have a GMT greater than about 1,500 g/3", and more preferably greater than about 1,750 g/3" and still more preferably greater than about 2,000 g/3", such as from about 1,500 to about 4,000 g/3", such as from about 2,000 to about 3,500 g/3". In other instances bath tissue products prepared according to the present disclosure may have a GMT less than about 1,000 g/3", such as from about 500 to about 1,000 g/3".

As used herein, the term "stiffness index" refers to the quotient of the geometric mean tensile slope, defined as the square root of the product of the MD and CD slopes (typically having units of kg), divided by the geometric mean tensile strength (typically having units of grams per three inches).

$$\text{Stiffness Index} = \frac{\sqrt{MD\ \text{Tensile Slope (kg)} \times CD\ \text{Tensile Slope (kg)}}}{GMT\ (g/3'')}$$

While the Stiffness Index may vary, tissue products prepared according to the present disclosure may, in certain embodiments, have a Stiffness Index less than about 10.0, more preferably less than about 8.0. In certain instances single ply paper towel products prepared according to the present invention may have a GMT from about 1,500 to about 2,500 g/3" and a Stiffness Index from about 3.5 to about 5.0. In other instances multi-ply paper towel products prepared according to the present invention may have a GMT from about 2,000 to about 3,500 g/3" and a Stiffness Index from about 3.5 to about 5.0. In still other instances bath tissue products prepared according to the present invention may have a GMT less than about 1,000 g/3" and a Stiffness Index from about 5.0 to about 8.0.

As used herein the term "tensile ratio" generally refers to the ratio of machine direction (MD) tensile (having units of g/3") and the cross-machine direction (CD) tensile (having units of g/3"). While the Tensile Ratio may vary, tissue products prepared according to the present disclosure may, in certain embodiments, have a Tensile Ratio less than about 2.5, such as from about 1.0 to about 2.5, such as from about 1.2 to about 2.0.

As used herein the term "discrete" when referring to an element disposed on a tissue sheet or papermaking fabric generally means that the element is visually unconnected from other elements and does not extend continuously in any dimension of the papermaking fabric or tissue sheet surface.

As used herein, the term "uninterrupted" generally refers to a protuberance having an upper surface plane that extends without interruptions and remains above the valley bottom plane for the length of the protuberance. Undulations of the upper surface plane within a protuberance along its length such as those resulting from twisting of warp filaments or warp filaments forming the protuberance tucking under one another are not considered to be interruptions.

As used herein the term "background pattern" refers to a pattern that substantially covers the surface of a tissue product. One of skill in the art may appreciate that a background pattern may be distinguished from a repeating pattern because a repeating pattern may comprise a plurality of line segment patterns, line segment axes, and cells whereas, in some embodiments, a background pattern may only comprise a single feature which is repeated at any frequency and/or interval. In other embodiments, a background pattern comprises a plurality of features which may form a repeating unit. A repeating unit may be described as a design comprising a plurality of one or more base patterns.

As used herein the term "embossed" when referring to a tissue product means that during the manufacturing process one or more of the tissue plies that make up the product have been subjected to a process which converts a smooth surfaced tissue web to a decorative surface by replicating an embossing pattern on one or more embossing rolls, which form a nip through which the tissue web passes. Embossed does not include wet molding, creping, microcreping, printing or other processes that may impart a texture and/or decorative pattern to a tissue web.

DETAILED DESCRIPTION

The present inventors have now surprisingly discovered that certain woven papermaking fabrics, and in particular woven transfer and through-air drying (TAD) fabrics, having a first plurality of protuberances oriented in the machine direction (MD) and a second plurality protuberances oriented in the cross-machine direction (CD) may be used to produce tissue webs and products having high bulk and visually appealing aesthetics without compromising operating efficiency. For example, in certain embodiments, the present invention provides a papermaking fabric having a machine contacting surface and an opposite web contacting surface, the web contacting surface comprising a plurality of spaced apart MD oriented protuberances and a plurality of CD oriented protuberances disposed thereon, where the CD oriented protuberances are discrete and comprise less than about 15 percent of the surface area of the web contacting surface of the fabric and more preferably less than about 10 percent, and still more preferably less than about 8 percent, such as from about 2 to about 10 percent, such as from about 2 to about 8 percent, such as from about 2 to about 5 percent.

Despite comprising a relatively small amount of the surface area of the web contacting surface, the CD oriented protuberances have a significant effect on the physical properties of tissue sheets and products manufactured using the instant fabrics—such as improving sheet bulk and enabling the winding of spirally wound rolls having high roll bulk and good firmness. Additionally, the inventive papermaking fabrics are well suited for the manufacture of both paper towel and bath tissue products having good roll bulk and firmness. For example, the fabric may be used to produce a rolled bath tissue product having a basis weight less about 50 grams per square meter (gsm), a geometric mean tensile (GMT) strength less than about 1,000 g/3", a caliper of at least about 350 μm and a roll structure of about 0.75 greater and more preferably about 1.0 or greater. In other instances the fabric may be used to produce a rolled paper towel product having a basis weight greater than about 35 gsm, a GMT greater than about 1,500 g/3", a caliper of about 700 μm or greater and a roll structure of about 1.5 or greater and more preferably about 1.75 or greater.

Accordingly, the instant papermaking fabrics may be used in the manufacture of a broad range of paper products, particularly wet-laid tissue webs and more particularly, wet-laid tissue products such as bath tissues, facial tissues, paper towels, industrial wipers, foodservice wipers, napkins, and other similar products. Further, the inventive fabrics are well suited for use in a wide variety of tissue manufacturing processes. For example, the fabrics may be used as TAD fabrics in either uncreped or creped applications to generate aesthetically acceptable patterns and good, bulky tissue product attributes. Alternatively, the fabrics may be used as impression fabrics in wet-pressed papermaking processes.

In certain embodiments the fabrics comprise a support structure formed from interweaving shute and warp filaments. Depending on the intended application of the papermaking fabrics, the shute count may be from about 10 to about 80 ends per inch, more preferably from about 20 to about 60 ends per inch, and still more preferably from about 25 to about 40 ends per inch. Warp filaments useful in weaving the fabrics may have a diameter from about 0.2 to about 0.7 mm, such as from about 0.3 to about 0.5 mm.

The woven support structure preferably comprises a plurality of MD oriented protuberances, which may be continuous or discrete. In a particularly preferred embodiment the MD oriented protuberances are continuous and have a width of from about 0.2 to about 2.5 mm, such as from about 0.5 to about 2.0 mm and the frequency of occurrence of the MD oriented protuberances in the cross-machine direction of the fabric is from about 0.5 to about 8 per centimeter, such as from about 3.2 to about 7.9 per centimeter, such as from about 4.2 to about 5.3 per centimeter.

In those instances where the MD oriented protuberances are formed by interweaving shute and warp filaments, the protuberances may have a height, generally measured as the z-directional length between the uppermost surface of a warp filament forming the protuberance and the valley bottom plane, from about 250 to about 350 percent of the diameter of the warp strand forming the protuberance, such as from about 260 to about 300 percent of the warp strand diameter. In other instances, where warp strands of multiple diameters are used to weave the protuberance, the height may be from about 105 to about 125 percent of the weighted-average shute diameters.

The MD oriented protuberances may be substantially aligned with the MD axis of the fabric or they may have a non-zero element angle. For example, the warp filaments may be woven to form protuberances extending in a continuous manner across the fabric and slightly skewed relative to the MD axis of the fabric. In this manner the MD oriented protuberances may have a non-zero element angle, such as an element angle from about 0.5 to 20 degrees, such as from about 2 to about 15 degrees, and more preferably from about 2 to about 10 degrees. In a particularly preferred embodiment the web contacting surface of the fabric comprises a plurality of spaced apart, parallel, MD oriented protuberances having an element angle from about 2 to about 10 degrees.

In certain embodiments the MD oriented protuberances may be arranged in a continuous pattern, extending from a first lateral edge of the fabric to a second lateral edge, in which adjacent protuberances are generally parallel to one another and equally spaced apart. Between adjacent protuberances are valleys having sidewalls formed by the protuberances. In this manner, the valleys, like the protuberances, may be oriented at an angle relative to the MD axis of the fabric.

Papermaking fabrics having woven MD oriented protuberances suitable for use in the present invention may be prepared as described in U.S. Pat. Nos. 6,998,024 and 7,611,607, the contents of which are incorporated herein in a manner consistent with the present disclosure. In a particularly preferred embodiment the MD oriented protuberances may be substantially continuous and woven from two or more warp filaments grouped together and supported by multiple shute strands of two or more diameters as disclosed in U.S. Pat. No. 7,611,607. MD protuberances woven in this manner can be oriented at an angle of from 0 to about 15 degrees relative to the true machine direction of the fabric.

The MD oriented protuberances can be configured substantially the same in terms of any one or more characteristics of height, width, length or element angle. For example, in certain embodiments, substantially all the MD oriented protuberances have substantially similar characteristics of height, width and element angle. In other embodiments however, the MD oriented protuberances may be configured such that one or more characteristics of height, width, or length of the protuberances vary from one MD oriented protuberance to another MD oriented protuberance.

The fabric further comprises a plurality of second protuberances, which are generally oriented in the cross-machine direction and are preferably discrete. In particularly preferred embodiments the CD oriented protuberances are formed by topically applying a polymeric material to the woven support structure. Suitable methods of topical application include printing and extruding polymeric material onto the surface of the woven support structure. Particularly suitable polymeric materials include materials that can be strongly adhered to the woven support structure and are resistant to thermal degradation at typical tissue machine dryer operating conditions and are reasonably flexible, such as silicones, polyesters, polyurethanes, epoxies, polyphenylsulfides and polyetherketones.

In other embodiments the CD oriented protuberances may be formed by extruding a polymeric strand onto a woven support structure, such as that described in U.S. Pat. No. 6,398,910, the contents of which are incorporated herein in a manner consistent with the present discourse. In such embodiments the polymeric strand is applied so as to form a raised CD oriented protuberance above the upper most plane of the woven support structure.

Alternative methods of forming the CD oriented protuberances include applying cast or cured films, weaving, embroidering or stitching polymeric fibers into the surface.

Figure 5A:
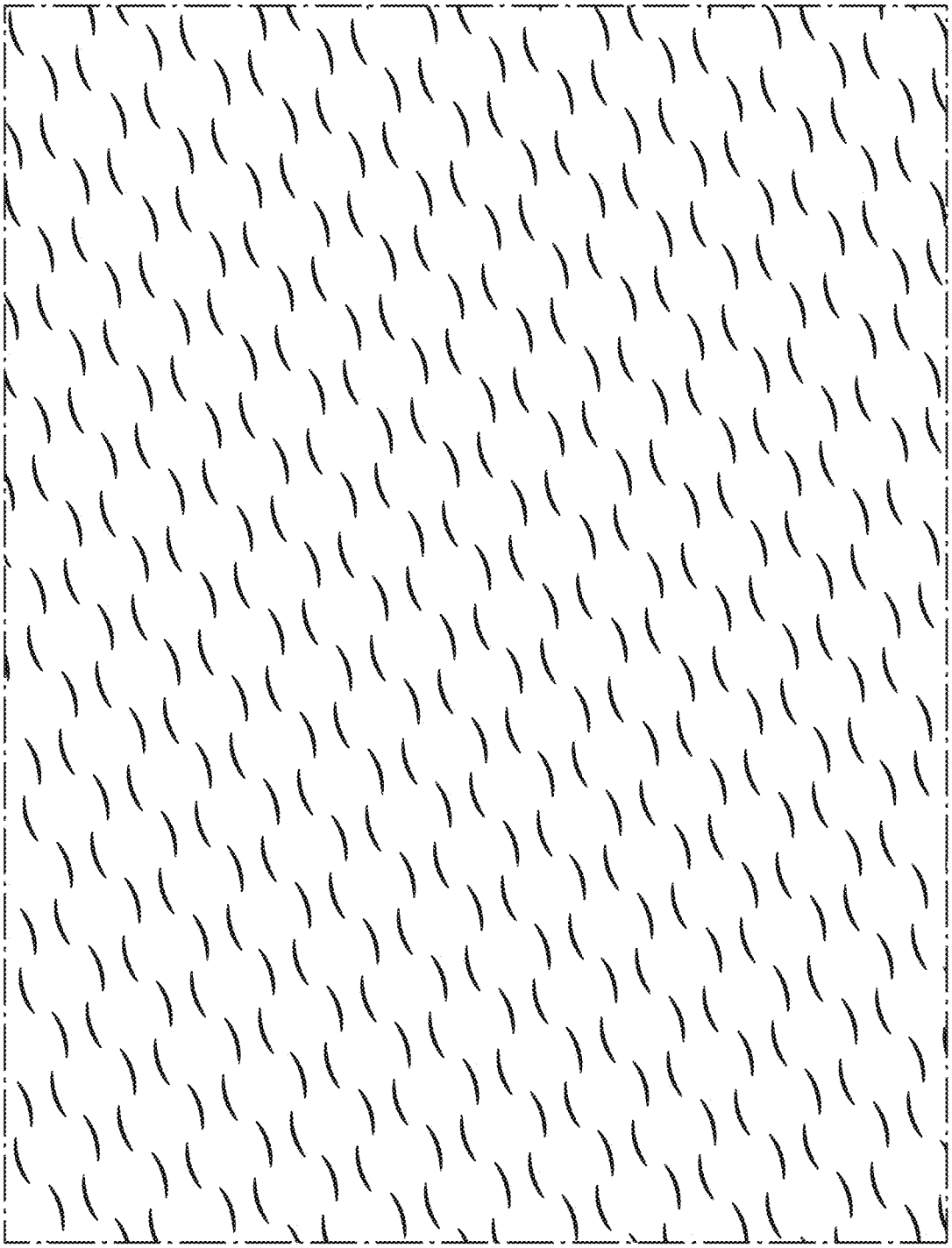
FIGS. 5A-5C illustrate various patterns of nonwoven elements useful in the present invention.
Figure 5B:
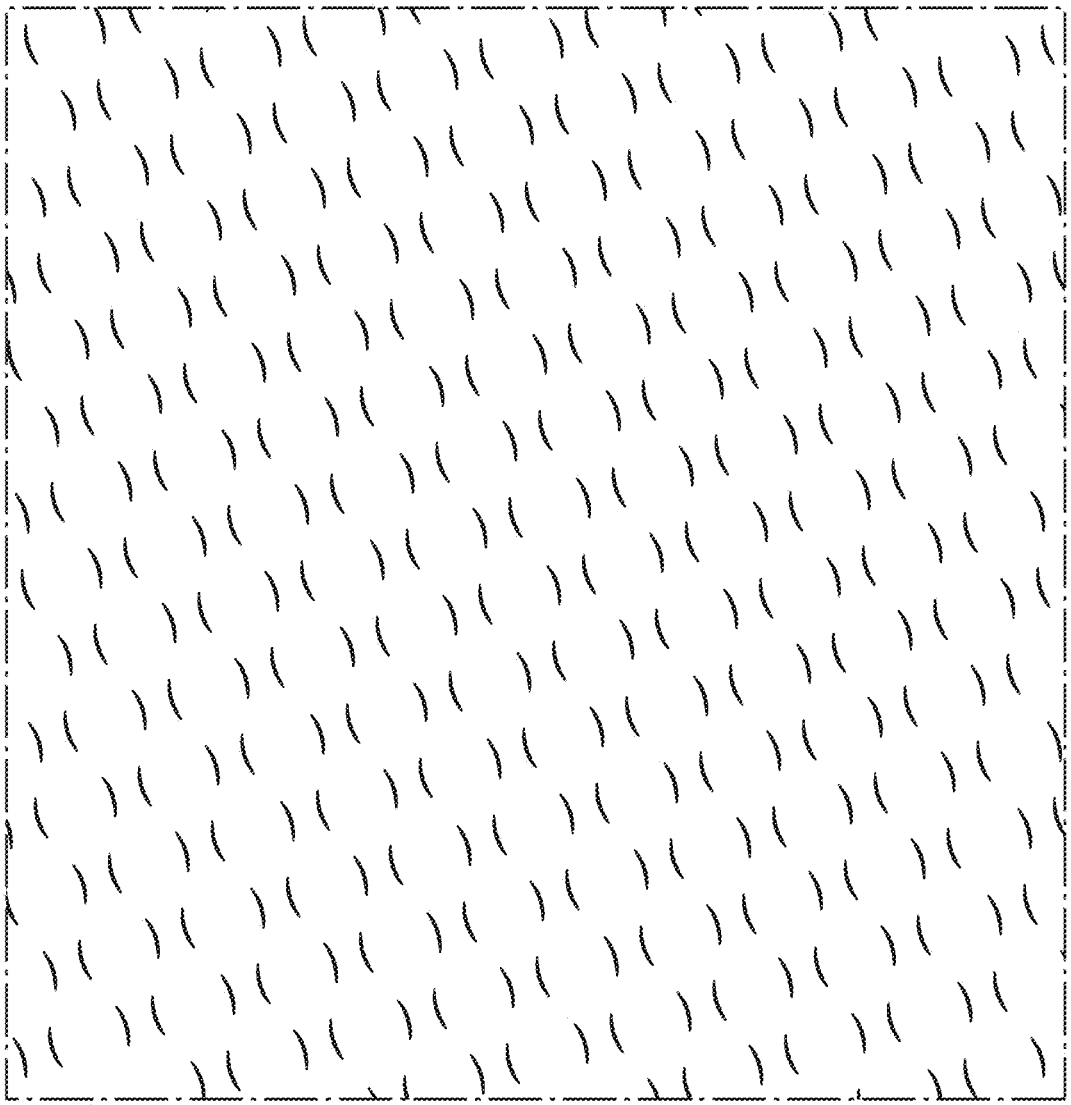
Figure 5C:
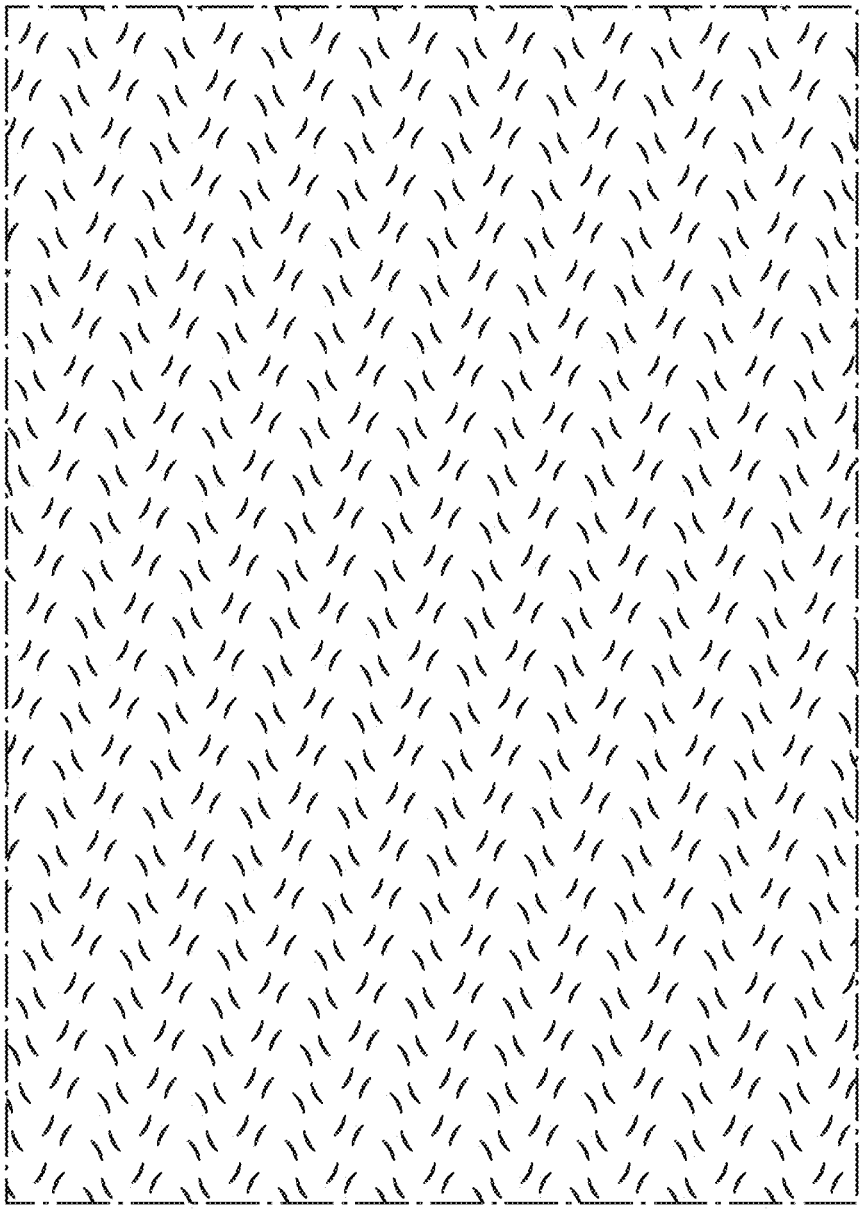

The CD oriented protuberances may be arranged on the web contacting surface of the fabric in a pattern. Suitable patterns useful in the present invention are illustrated in FIGS. 5A-5C. For example, with reference to FIG. 5A, the CD oriented protuberances may be discrete and occur in a regular, repeating pattern comprising pairs of protuberance, such as first pair of protuberances and second pair of protuberances, spaced apart from one another in the cross-machine direction (D1) at least about 5.0 mm and more preferably at least about 10.0 mm. Within a given pair of protuberances, the protuberances may be spaced apart a distance (D2) from about 2.0 to about 6.0 mm, such as from about 2.0 to about 5.0 mm.

In other embodiments the CD oriented protuberances may be arranged in a pattern such that each CD oriented protuberance contacts, and more preferably traverses, at least one MD oriented protuberance and in certain instances two or more adjacent MD oriented protuberances. In those embodiments where a CD protuberance contacts adjacent MD oriented protuberances, the CD protuberance may extend across the entire width of a valley and form a valley endwall.

With continued reference to FIG. 5A, pairs of CD oriented protuberances may be spaced apart from other pairs of protuberances in the machine direction a distance (D3) from about 3.0 to about 10.0 mm, such as from about 4.0 to about 6.0 mm. Further, the pair of CD oriented protuberances may be arranged parallel to one another and have an element angle from about 20 to about 45 degrees and more preferably from about 25 to about 40 degrees.

Regardless of the whether the CD oriented protuberances are arranged in a pattern or are randomly distributed on the web contacting surface of the fabric, the percentage the web contacting surface that is covered by CD oriented protuberances is generally less than about 15 percent of the surface area of the web contacting surface of the fabric and more preferably less than about 10 percent, and still more preferably less than about 8 percent, such as from about 2 to about 10 percent, such as from about 2 to about 8 percent, such as from about 2 to about 5 percent.

In certain preferred embodiments the CD oriented protuberances comprise a polymeric material disposed on the woven support structure such that the upper surface of the CD oriented protuberance lies above the surface of the upper most filament of the woven support structure. In this manner the CD oriented protuberance may form the upper most surface plane of the papermaking fabric and may have a height, generally measured from the valley bottom plane, greater than about 1,000 μm, such as from about 1,000 to about 2,000 μm. In other instances the upper most surface of the woven portion of the fabric may have a height from about 500 to about 1,000 μm and the upper most surface of the CD oriented protuberance may have a height from about 1,000 to about 2,000 μm.

With reference now to FIG. 1, one embodiment of a papermaking fabric 10 according to the present invention is illustrated. The fabric 10 has two principal dimensions—a machine direction (MD), which is the direction within the plane of the fabric 10 parallel to the principal direction of travel of the tissue web during manufacture, and a cross-machine direction (CD), which is generally orthogonal to the machine direction. The papermaking fabric 10 generally comprises a woven support structure consisting of filaments such as a plurality of warp filaments and a plurality of shute filaments woven together to form a machine contacting surface and a web contacting surface 20.

With continued reference to FIG. 1, the web contacting surface 20 of the fabric 10 comprises a plurality of MD oriented protuberances 22 and a plurality of CD oriented protuberances 38. The protuberances 22, 38 are generally disposed on the web contacting surface 20 for cooperating with, and structuring of, the wet fibrous web during manufacturing. In certain embodiments the CD oriented elements 38 may be disposed on the web contacting surface 20 in a pattern comprising a repeating motif 40 of first and second CD oriented protuberances 38*a*, 38*b* having substantially similar shape and size and arranged in a pair wise fashion with similar element angles. The element angle of the CD oriented protuberance (β), which is generally measured as the angle between the MD axis 27 and the longitudinal axis 29 of the protuberance 38 may range from about 20 to about 40 degrees, such as from about 25 to about 35 degrees.

Regardless of whether the CD oriented protuberances 38 are disposed in a pattern or are randomly disposed on the web contacting surface 20, the protuberances 38 generally comprise less than about 15 percent of the web contacting surface 20 of the fabric 10 and more preferably less than about 10 percent, and still more preferably less than about 8 percent, such as from about 2 to about 10 percent, such as from about 2 to about 8 percent, such as from about 2 to about 5 percent of the web contacting surface 20 of the fabric 10.

The MD oriented protuberances 22 may extend generally in a first direction along a major axis 25 across one dimension of the fabric 10 in a continuous fashion. In this manner a protuberance 22 may extend from a first lateral edge 17 to a second lateral edge 19. In such embodiments the length of the protuberance is dependent upon the length of the fabric 10 and the angle of the protuberance relative to the machine direction (MD). For example, the protuberances 22 may be arranged in a parallel fashion and extend along a major axis 25 at an angle (a) relative to the machine direction axis 27. In this manner the protuberances 22 generally have a long direction axis, i.e., the major axis 25, that intersects the machine direction axis 27 to form an element angle (a), which may be greater than about 0.5 degrees, such as from about 2.0 to about 15.0 degrees, such as from about 5.0 to about 10.0 degrees. While the MD oriented protuberances 22 illustrated in FIG. 1 are arranged in a parallel fashion and have the same element angle (a), the invention is not so limited. In other embodiments the element angle may vary amongst the MD oriented protuberances and in still other embodiments the MD oriented protuberances may intersect one another.

With continued reference to FIG. 1, the web contacting surface 20 may comprise a plurality of valleys 24, which are generally bounded by adjacent MD oriented protuberances 22 and are coextensive with the upper surface plane of the fabric 10. With reference to valley 24*a*, the valley is discrete and bounded on four sides by protuberances 22*a*, 22*b* and 38*c*, 38*d*. In this manner the valley 24*a* has the shape of a parallelogram with endwalls formed by a pair of spaced apart CD oriented protuberances 38*c*, 38*d* and sidewalls formed by a pair of spaced apart MD oriented protuberances 22*a*, 22*b*. The valleys 24 are generally permeable to liquids and allow water to be removed from the cellulosic tissue web by the application of differential fluid pressure, by evaporative mechanisms, or both when drying air passes through the embryonic tissue web while on the papermaking fabric 10 or a vacuum is applied through the fabric 10. Without being bound by any particularly theory, it is believed that the arrangement of protuberances and valleys allow the molding of the embryonic web causing fibers to deflect in the z-direction and generate the caliper of, and patterns on the resulting tissue web.

Figure 2:
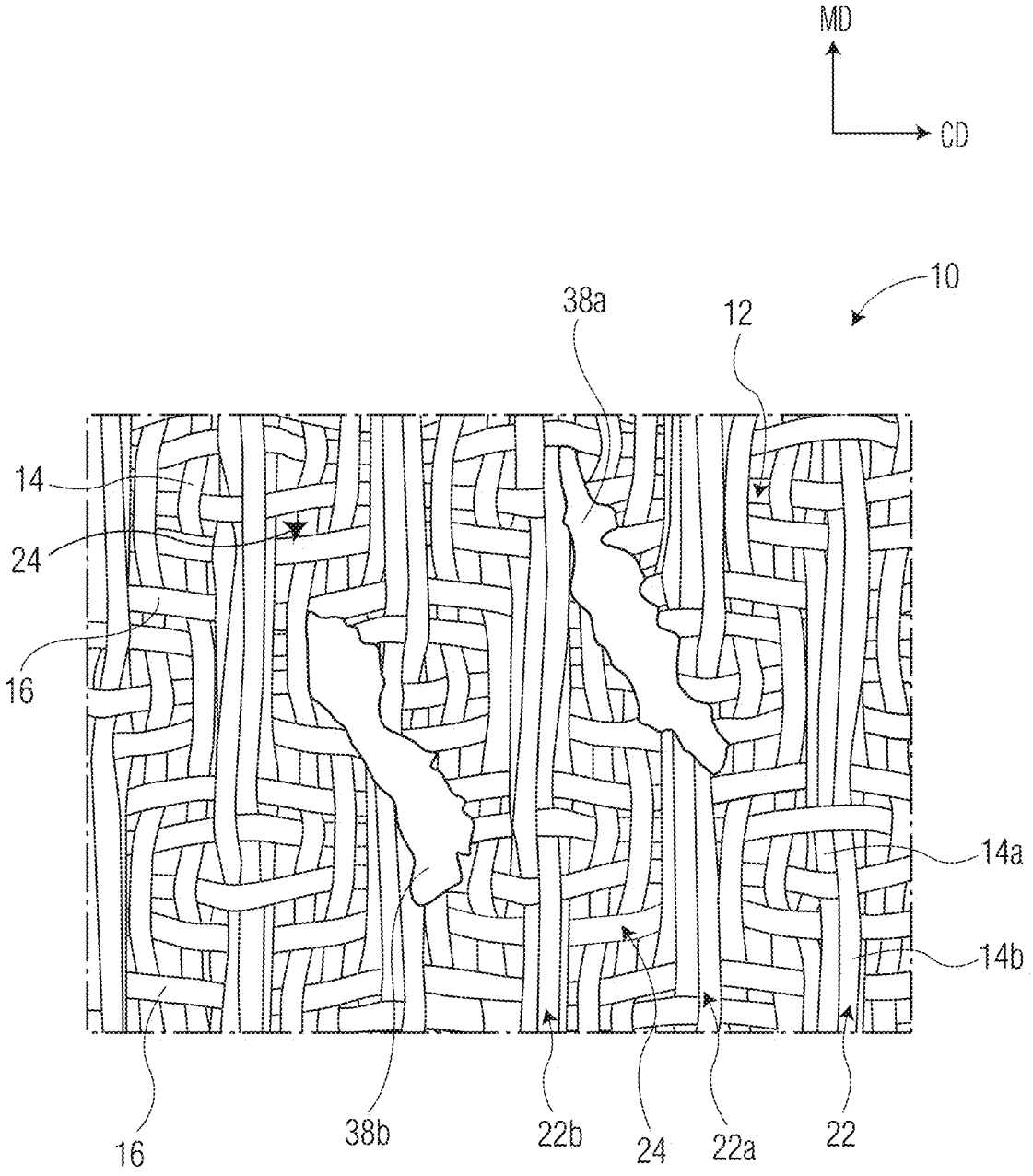
FIG. 2 is top plan view of a papermaking fabric according to one embodiment of the present invention.
Figure 3:
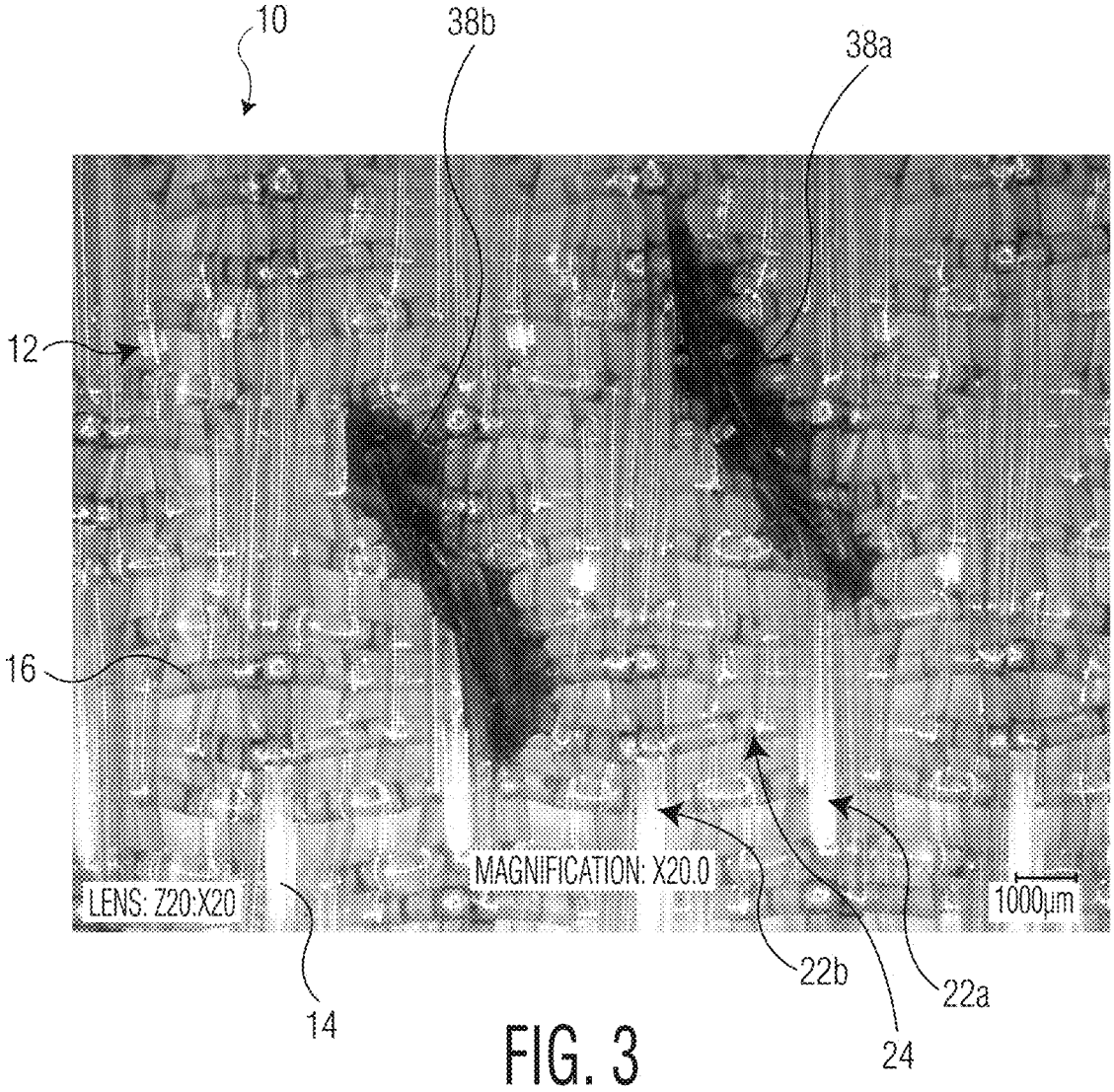
FIG. 3 is an image of a papermaking fabric according to another embodiment of the present invention taken at 100× magnification using a Keyence VHX-5000 Digital Microscope (Keyence Corporation, Osaka, Japan)

With reference now to FIG. 2 the fabric 10 may comprise a woven support structure 12 comprising interwoven shute and warp filaments 14, 16. The filaments may be interwoven such that the MD oriented protuberances 22 is formed by a pair of warp filaments 14*a*, 14*b*. The fabric 10 may further comprise a plurality of CD oriented protuberances, such as CD oriented protuberance 38*a*, 38*b*, which may be formed by printing a polymeric material onto the support structure 12 such that the protuberance 38*a*, 38*b* lie above the warp filaments 14 and span a pair of spaced apart MD oriented protuberances, such as protuberances 22*a* and 22*b*.

The fabric 10 may further comprise a plurality of valleys 24 bounded by spaced apart MD oriented protuberances 22*a*, 22*b*. The valleys may, in certain instances be further bound by spaced apart CD oriented protuberances to provide the fabric with discrete valleys. For example, as illustrated in FIG. 2, one end of the valley 24 is bound by CD oriented protuberance 38*a*, which spans a pair of spaced apart MD oriented protuberances 22*a*, 22*b*.

The shape of the MD protuberances, such as the height, width and cross-sectional shape, may vary depending on the size, shape and number of warp filaments that make up the protuberance. For example a pair of warp filaments may be bundled together to form a protuberance, which in certain instances may have a semi-circular cross-sectional shape. Further, the upper surface of the warp filaments lie in an upper surface plane above the valley bottom plane in the z-direction providing the woven MD oriented protuberance with a height. In certain instances the height of the protuberances may be altered by selecting warp filaments of different sizes and shapes and by the number of warps forming a given protuberance.

The MD oriented protuberance height may range from about 0.1 to about 5.0 mm, more preferably from about 0.2 to about 3.0 mm, or even more preferably from about 0.5 to about 1.5 mm. Of course, it is contemplated that the height can be outside of this preferred range in some embodiments. Further, while the height of the protuberances is generally illustrated herein as being substantially uniform amongst the protuberances, the invention is not so limited and the protuberances may have different heights.

The MD oriented protuberance width may also vary depending on the construction of the fabric and its intended use. For example, the width of the protuberances may be influenced by the number of warp filaments used to form the MD oriented protuberance, as well as the diameter of the filament used for a given warp float. In certain embodiments a protuberance may comprise from 2 to 8, such as 4 to 6, warp filaments. In other instances the warp filaments may have a diameter from about 0.2 to about 0.7 mm, such as from about 0.3 to about 0.5 mm and the protuberances may be woven from 2 to 6 adjacent warp filaments.

With reference again to FIG. 2, the CD protuberances 38*a*, 38*b* may be formed from a polymeric material printed on the woven support structure 12 and may be disposed between a pair of adjacent MD protuberances 22*a*, 22*b*. In other instances the CD protuberances may traverses at least one MD oriented protuberance. The CD protuberance may have a length, measured along the long axis of the protuberance, of from about 2.0 to about 15.0 mm, such as from about 3.0 to about 10.0 mm, and more preferably from about 5.0 to about 8.0 mm. In certain embodiments all of the CD protuberances disposed on the web contacting surface of the sheet are discrete and have a substantially similar length, such as a length from about 3.0 to about 10.0 mm, and more preferably from about 5.0 to about 8.0 mm. Further, the CD protuberance may have a width, generally measured at the widest point of the protuberance normal to the longest axis of the protuberance, from about 600 to about 1,500 μm, such as from about 800 to about 1,200 μm.

The spacing and arrangement of protuberances may vary depending on the desired tissue product properties and appearance. If the individual protuberances are too high, or the valley area is too small, the resulting sheet may have excessive pinholes and insufficient compression resistance and be of poor quality. Further, tensile strength may be degraded if the span between adjacent MD protuberances greatly exceeds the fiber length. Conversely, if the spacing between adjacent MD protuberances is too small the tissue will not mold completely into the fabric negatively affecting important sheet properties such as sheet caliper and cross-machine direction properties such as stretch and tensile energy absorption.

In particularly preferred embodiments the invention provides a papermaking fabric having a machine contacting surface and an opposite web contacting surface, wherein the web contacting surface comprises a plurality of MD oriented protuberances extending continuously throughout one dimension of the fabric and each of the plurality of MD protuberances are spaced apart from one another. Thus, the MD oriented protuberances may be spaced apart across the entire cross-machine direction of the fabric or may run diagonally relative to the machine direction and have an element angle from about 2 to about 10 degrees. Further the MD oriented protuberances may all be similarly shaped and sized. The web contacting surface further comprises a plurality of substantially CD oriented protuberances, where the CD protuberances are discrete and contact at least one MD oriented protuberance and have a length from about 3.0 to about 10.0 mm and have an element angle greater than about 20 degrees, such as from about 20 to about 40 degrees and more preferably from about 25 to about 35 degrees.

The MD oriented protuberances generally define valleys there between. The valleys are preferably air and liquid permeable and have an upper surface that defines the lowest web contacting surface of the fabric. Depending on the shape and size of the MD oriented protuberances, the valley depths may vary, such as about 0.30 mm or greater, such as from about 0.30 to about 2.00 mm, such as from about 0.50 to about 1.50 mm. In certain instances at least a portion of the valleys may be further bound by CD oriented protuberances, which may span a pair of adjacent MD oriented protuberances and form the valley endwalls. In such instances a portion of the valleys may be discrete, having sidewalls defined by the spaced part MD oriented protuberances and endwalls defined by spaced apart CD oriented protuberances. The discrete valleys may have a length of about 10 mm or greater, such as about 15 mm or greater, such as about 20 mm or greater, such as from about 10 to about 30 mm, such as from about 15 to about 30 mm, such as from about 20 to about 30 mm.

In certain embodiments the fabric may comprise a web contacting surface having a plurality of substantially similarly shaped valleys having first and second sidewalls formed by MD oriented protuberances and first and second endwalls formed by CD oriented protuberances where the valleys have a length of about 10 mm or greater, such as about 15 mm or greater, such as about 20 mm or greater, such as from about 10 to about 30 mm, such as from about 15 to about 30 mm, such as from about 20 to about 30 mm.

Figure 4:
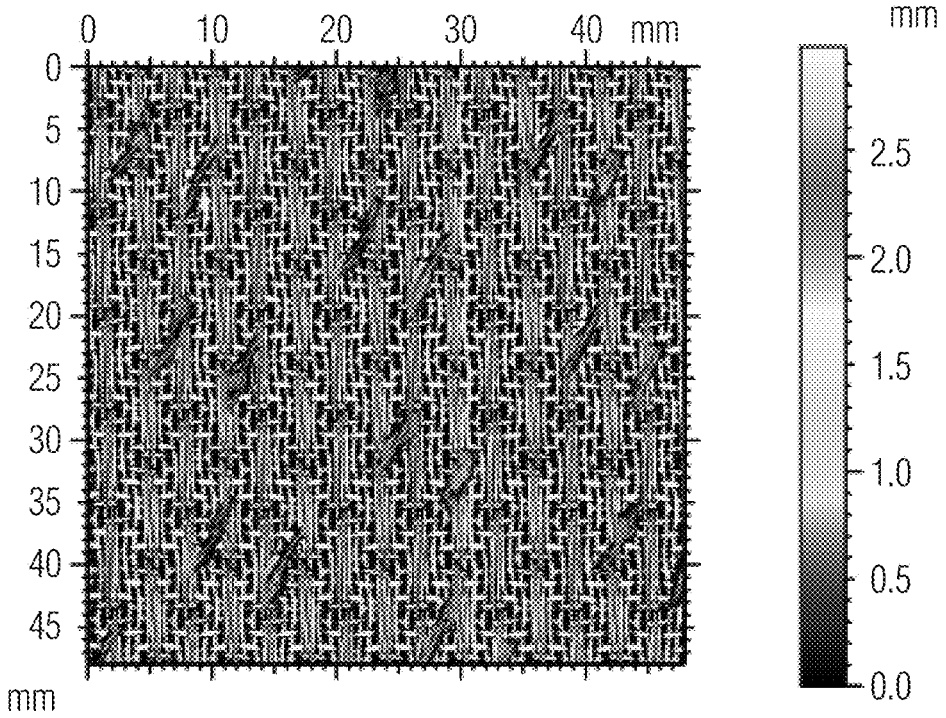
FIG. 4 is a profilometry scan of a papermaking fabric according to another embodiment of the present invention taken using a FRT MicroSpy® Profile profilometer (FRT of America, LLC, San Jose, Calif.)

Several exemplary papermaking fabrics are illustrated in the attached figures. The illustrated fabrics are woven so as to form a plurality of MD oriented protuberances and have nonwoven CD oriented protuberances, which in certain instances define discrete valleys there between. The illustrated fabrics generally have valley depths greater than about 0.30 mm, such as from about 0.30 to about 2.00 mm, such as from about 0.50 to about 1.50 mm. For example, as illustrated in the profilometry scan of FIG. 4, the valleys generally form the lowest most portion of the web contacting surface of the fabric and are bounded by woven MD oriented protuberances and nonwoven CD oriented protuberances. The valleys have a depth of about 1.0 mm and the nonwoven CD oriented protuberances form the upper most portion of the web contacting surface.

The CD oriented protuberances may be disposed on the fabric in any number of different patterns. Three exemplary CD oriented protuberance patterns are illustrated in FIGS. 5A-5C. The patterns may be arranged such that the CD oriented protuberances cover less than about 15 percent of the web contacting surface 20 of the fabric 10 and more preferably less than about 10 percent, and still more preferably less than about 8 percent, such as from about 2 to about 10 percent, such as from about 2 to about 8 percent, such as from about 2 to about 5 percent of the web contacting surface 20 of the fabric 10. The pattern may further comprise substantially similarly shaped and sized CD oriented protuberances that have similar element angles, which are generally greater than about 20 degrees. The CD oriented protuberances may all have substantially similar element angles or the angles may be varied amongst the protuberances.

The inventive papermaking fabrics disclosed herein may be useful in a number of tissue manufacturing processes. In particularly preferred embodiments the fabrics are useful as through-air drying fabrics where the web contacting surface three-dimensional topography facilitates the molding and structuring of the nascent tissue web during manufacture. The molding and structuring of the web during manufacture may impart three-dimensionality to the resulting tissue sheet or ply. In certain instances the three-dimensionality imparted to the resulting sheet or ply affects the physical properties of the finished tissue product, such as sheet bulk, stretch, and tensile energy absorption. For example, the finished product may comprise a plurality of substantially machine direction (MD) oriented ridges that may be pulled out when the product is subjected to strain in the cross-machine direction (CD) resulting in increased CD stretch and tensile energy absorption.

In a particularly preferred embodiment one or more of the tissue plies may be manufactured by a through-air dried process using the inventive fabric disclosed herein. In such processes the embryonic web is noncompressively dried. For example, tissue plies useful in the present invention may be formed by either creped or uncreped through-air dried processes. Particularly preferred are uncreped through-air dried webs, such as those described in U.S. Pat. No. 5,779,860, the contents of which are incorporated herein in a manner consistent with the present disclosure.

In other embodiments one or more of the tissue plies may be manufactured by a process including the step of using pressure, vacuum, or air flow through the wet web (or a combination of these) to conform the wet web into a shaped fabric and subsequently drying the shaped sheet using a Yankee dryer, or series of steam heated dryers, or some other means, including but not limited to tissue made using the ATMOS process developed by Voith or the NTT process developed by Metso; or fabric creped tissue, made using a process including the step of transferring the wet web from a carrying surface (belt, fabric, felt, or roll) moving at one speed to a fabric moving at a slower speed (at least 5 percent slower) and subsequently drying the sheet. Those skilled in the art will recognize that these processes are not mutually exclusive, e.g., an uncreped TAD process may include a fabric crepe step in the process.

Accordingly, in addition to providing inventive papermaking fabrics, the present invention provides novel tissue products, which may comprise one, two or more plies that are manufactured using the same or different tissue making techniques. In one embodiment the invention provides a single ply tissue product having a basis weight greater than about 20 gsm, such as from about 20 to about 60 gsm, such as from about 35 to about 55 gsm, such as from about 35 to about 45 gsm. In other embodiments the present invention provides multi-ply tissue products having a basis weight greater than about 20 gsm, such as from about 20 to about 60 gsm, such as from about 35 to about 55 gsm.

In particularly preferred embodiments the tissue products of the present invention are produced using a noncompressive drying method which tends to preserve, or increase, the caliper or thickness of the wet web including, without limitation, through-air drying, infra-red radiation, microwave drying, etc. Because of its commercial availability and practicality, through-air drying is well-known and is a preferred means for noncompressively drying the web for purposes of this invention. The through-air drying process and tackle can be conventional as is well known in the papermaking industry. In certain instances it may be preferable to use a through-air drying fabric having a web contacting surface with three-dimensional topography as described above. After manufacture the web may be subsequently converted, as is well known in the art, by processes such as calendering, embossing, printing, lotion treating, slitting, cutting, folding, and packaging. Particularly preferred are processes that apply a plurality of embossments to at least one surface of the tissue web, as will be discussed in more detail below. Multi-ply products may be combined using well known techniques. In certain preferred embodiments the plies may be combined by a glue laminating embossing process which provides the tissue product with an embossing pattern on at least one of its outer surfaces.

In one embodiment of the present invention, the tissue product has a plurality of embossments. In one embodiment the embossment pattern is applied only to the first ply, and therefore, each of the two plies serve different objectives and are visually distinguishable. For instance, the embossment pattern on the first ply provides, among other things, improved aesthetics regarding thickness and quilted appearance, while the second ply, being unembossed, is devised to enhance functional qualities such as absorbency, thickness and strength. In another embodiment the fibrous structure product is a two-ply product wherein both plies comprise a plurality of embossments. Suitable means of embossing include, for example, those disclosed in U.S. Pat. Nos. 5,096,527, 5,667,619, 6,032,712 and 6,755,928.

Figure 6:
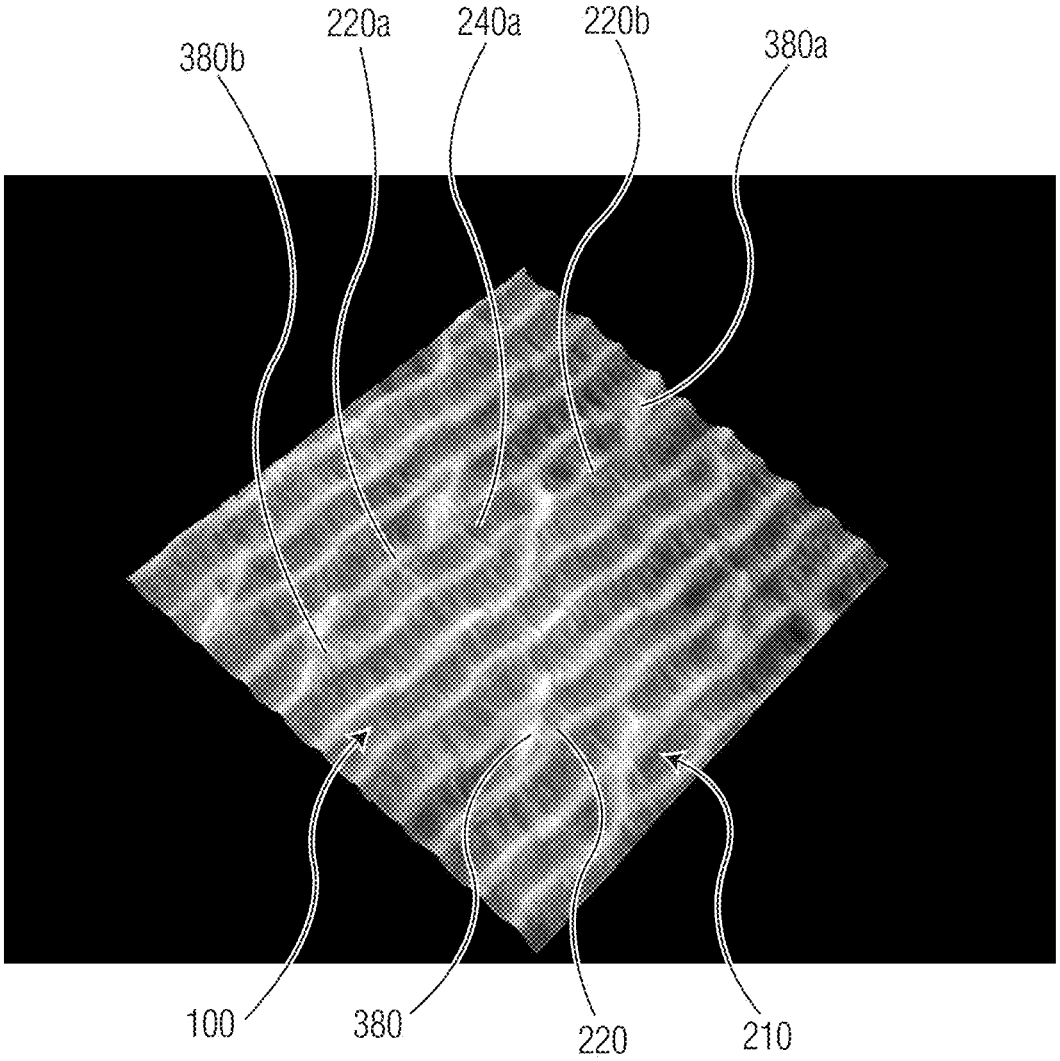
FIG. 6 is a 3D image of the air side of a tissue sheet according to one embodiment of the present invention obtained using a Keyence microscope and imaging software as described herein.
Figure 7:
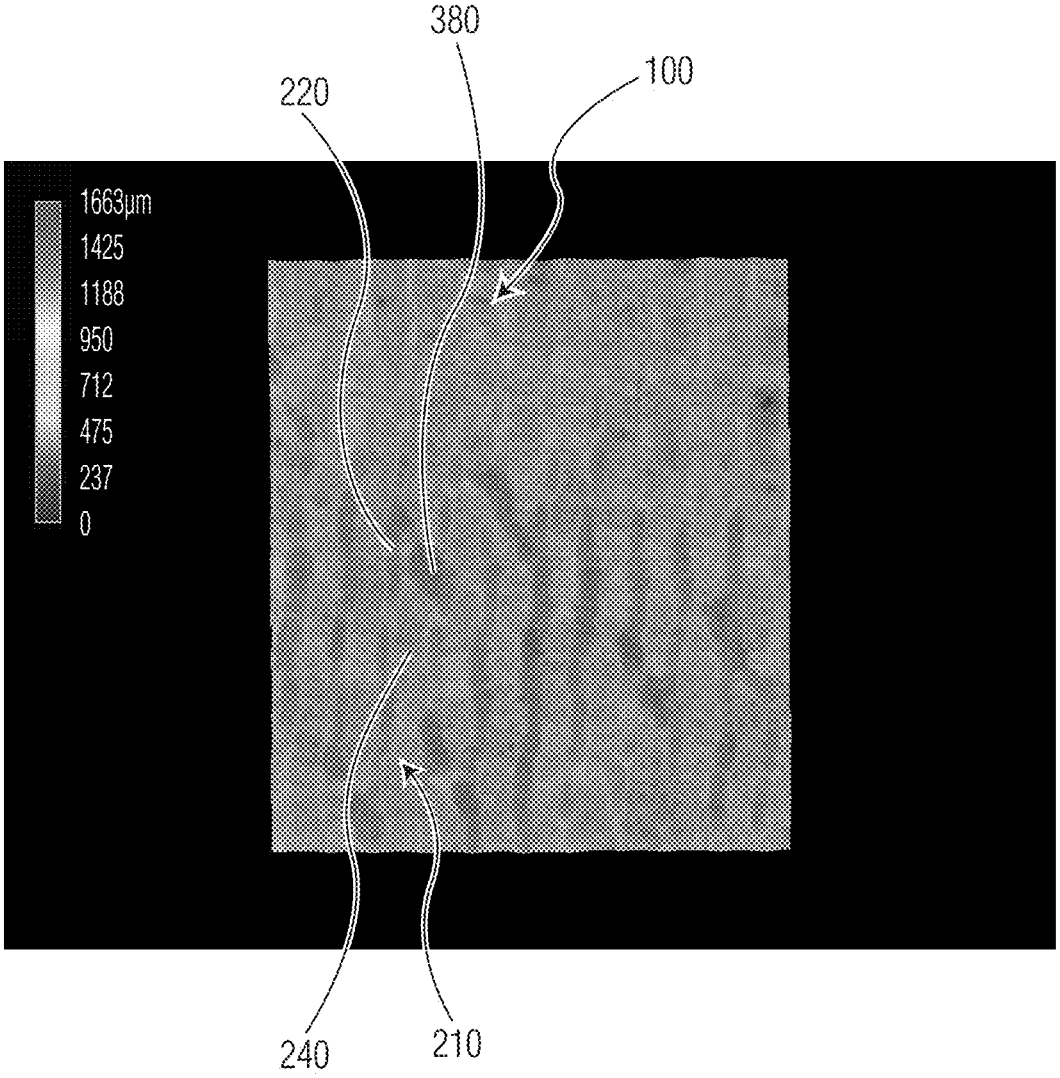
FIG. 7 is a 3D height map of the air side of the tissue sheet of FIG. 6.

One exemplary tissue product prepared according to the present invention is illustrated in FIGS. 6 and 7. As illustrated in FIGS. 6 and 7, which are images of the air side 210 of an inventive tissue product 100, the MD oriented elements 220 are spaced apart from one another and define a plurality of valleys 240 there between. The MD oriented elements 220 are elevated above the valleys 240 and are substantially continuous. The valleys 220 generally define the lowest surface of the product 100 and, in certain instances, are discontinuous. The valley discontinuities are formed by CD oriented elements 380, which together with the MD oriented elements 220 form the upper most surfaces of the tissue sheet.

At least a portion of the CD oriented elements span adjacent MD oriented elements to form valley endwalls and define the valley length, which is generally greater than about 10 mm, such as about 15 mm or greater, such as about 20 mm or greater, such as from about 10 to about 30 mm. One skilled in the art will appreciate that depending on the pattern of CD oriented elements, the valley lengths within a given tissue sheet may vary and an inventive tissue sheet may have valleys which are continuous or are discontinuous and certain discontinuous valleys may have a length outside of the preferred range.

Figure 8B:
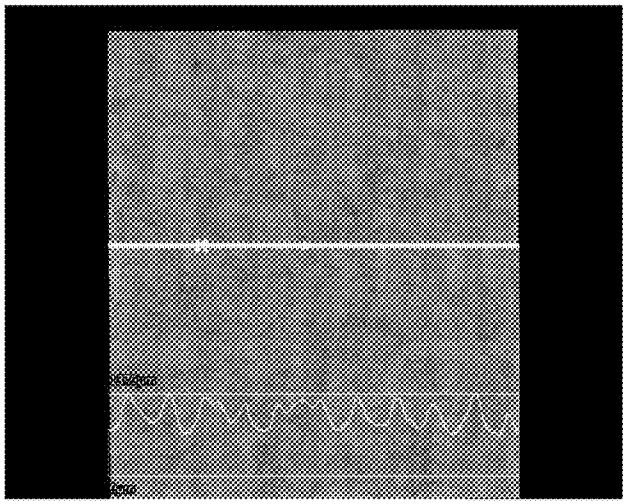
FIGS. 8A-8C illustrate the cross-machine direction profile of the air side of the tissue sheet of FIG. 6 obtained using a Keyence Microscope and imaging software as described herein.
Figure 8A:
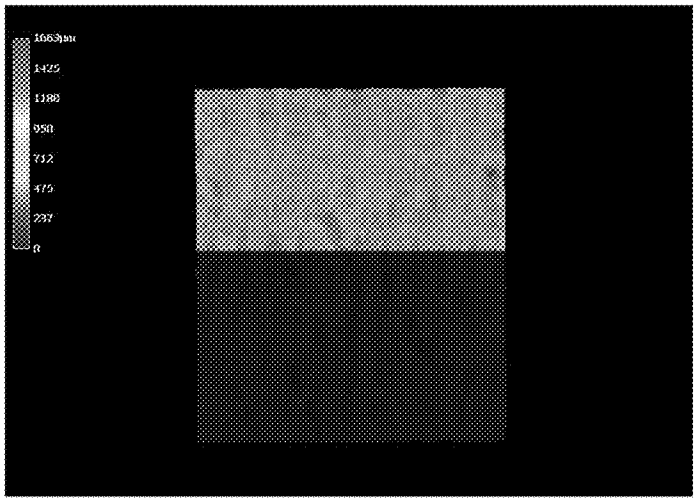
Figure 8C:
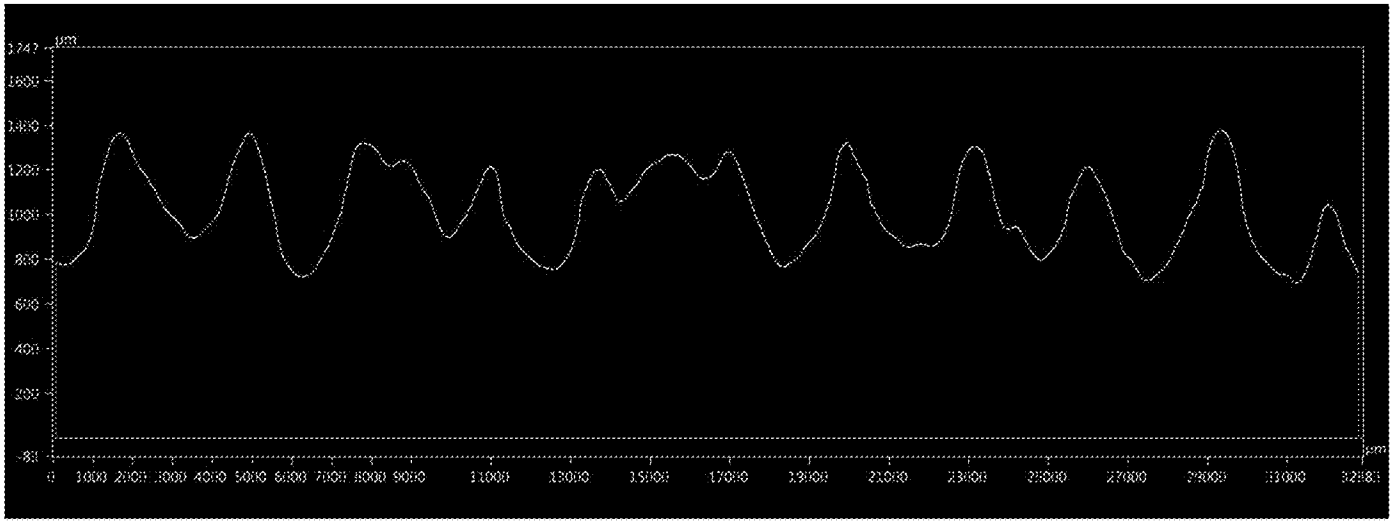

With reference now to FIGS. 8A-8C the height of the MD and CD oriented elements relative to the valleys is further illustrated. The MD and CD oriented elements may form the upper surface plane of the tissue sheet and the valley bottoms may form the lowest surface plane. The height difference between the lowest and uppermost surface planes may vary depending on the properties of the fabric used to manufacture the tissue sheet, as well as the basis weight of the tissue sheet and the manufacturing process.

In certain embodiments, the present invention provides a towel product comprising a single tissue ply having a basis weight greater than about 35 gsm and a GMT greater than about 1,500 g/3" where the air contacting side of the product comprises a valley having an upper surface lying in a valley bottom plane and MD and CD oriented elements having upper surfaces lying in an upper tissue surface plane where the distance between the valley bottom plane and the upper tissue surface plane is greater than about 500 μm, such as from about 500 to about 1,200 μm.

In other embodiments, the present invention provides a bath tissue product comprising a single tissue ply having a basis weight less than about 50 gsm and a GMT less than about 1,000 g/3" where the air contacting side of the product comprises a valley having an upper surface lying in a valley bottom plane and MD and CD oriented elements having upper surfaces lying in an upper tissue surface plane where the distance between the valley bottom plane and the upper tissue surface plane is greater than about 300 μm, such as from about 300 to about 600 μm.

Figure 9A:
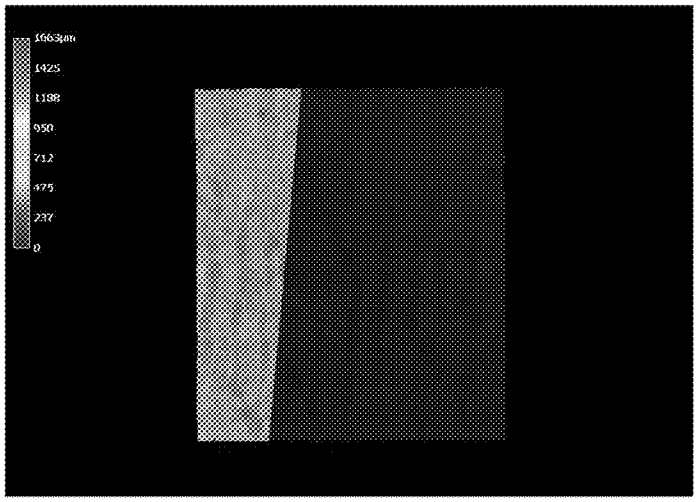
FIGS. 9A-9C illustrate the machine direction profile of the air side of the tissue sheet of FIG. 6 obtained using a Keyence Microscope and imaging software as described herein.
Figure 9B:
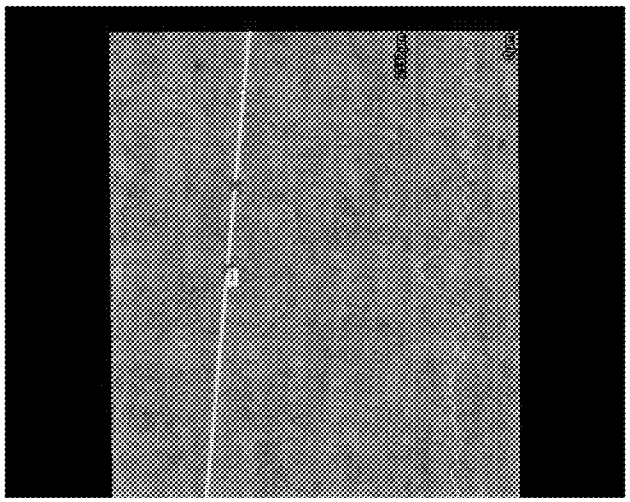
Figure 9C:
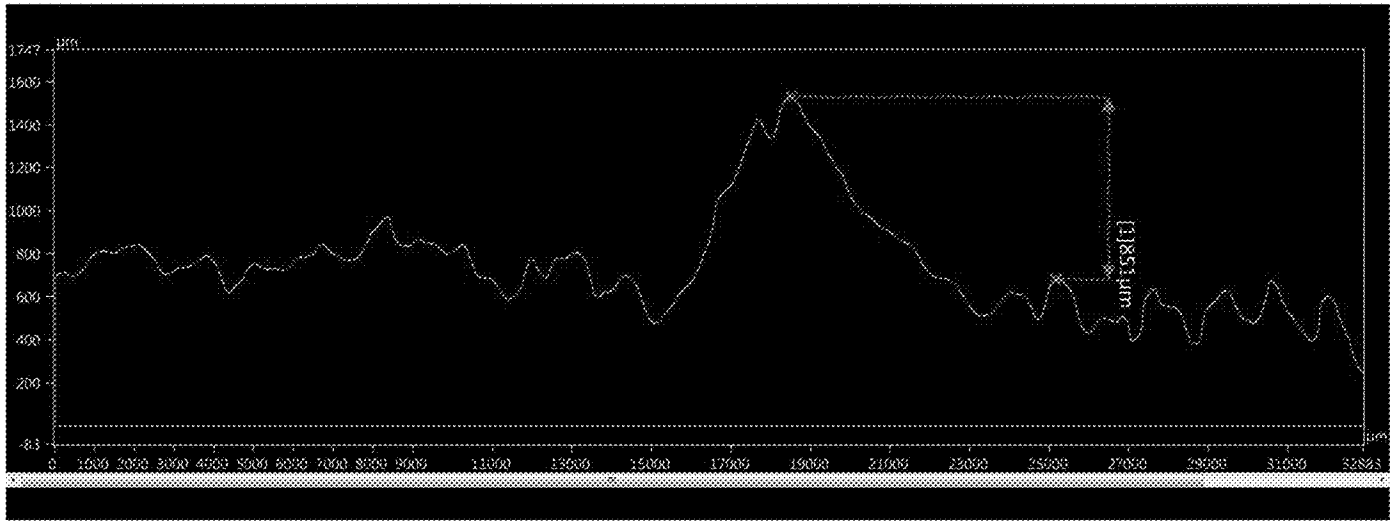

With reference now to FIGS. 9A-9C the cross-section profile of an inventive tissue sheet is illustrated along a valley and further illustrates the valley discontinuity caused by a CD oriented element. As illustrated in FIG. 9C the CD oriented element has an upper surface that lies above the valley bottom plane. Again, the distance between the valley bottom plane and the upper surface of the CD oriented element may vary depending upon depending on the properties of the fabric used to manufacture the tissue sheet, as well as the basis weight of the tissue sheet and the manufacturing process, but in certain embodiments may range from about 300 to about 1,200 μm, such as from about 400 to about 1,000 μm.

It is believed that by forming a tissue webs using a papermaking fabric having both MD and CD oriented protuberances, such as those disclosed herein, that nesting may be reduced when the webs are converted into rolled product forms. Reduced nesting may, in-turn, improve certain properties, such as bulk and firmness, of the rolled product. Typically, nesting arises as a result of using textured papermaking fabrics, which impart the tissue web with valleys and ridges. While these ridges and valleys can provide many benefits to the resulting web, problems sometimes arise when the web is converted into final product forms. For example, when webs are converted to rolled products, the ridges and valleys of one winding are placed on top of corresponding ridges and valleys of the next winding, which causes the roll to become more tightly packed, thereby reducing roll bulk, increasing density and making the winding of the product less consistent and controllable. Thus, in certain embodiments the present invention provides tissue products comprising a tissue web having MD and CD oriented elements, where the CD oriented elements reduce nesting of the web when it is converted into a rolled product. The resulting rolls generally have higher roll bulk at a given roll firmness. Further, the rolls generally have a surprising degree of interlocking between successive wraps of the spirally wound web, improving roll structure at a given roll firmness, more specifically allowing less firm rolls to be made without slippage between wraps.

Improving interlocking between successive wraps allows less firm rolls to be made without slippage between wraps. For example, compared to tissue products produced using a through-air drying fabric with an offset seam, such as those disclosed in U.S. Pat. No. 7,935,409, the contents of which are incorporated herein in a manner consistent with the present disclosure, rolled tissue products of the present disclosure have similarly improved roll structure and reduced nesting. One measure of the reduced nesting is improved roll structure. Generally rolled tissue products prepared according to the present invention have a roll structure greater than about 0.75, more preferably greater than about 1.0, still more preferably greater than about 1.5. For example, in one embodiment the invention provides a single ply bath tissue having a caliper from about 350 to about 550 μm wound into a roll having a roll structure greater than about 0.75. In another embodiment the invention provides a single ply paper towel having a caliper from about 600 to about 900 μm wound into a roll having a roll structure greater than about 1.5.

Not only are the inventive papermaking fabrics useful in the manufacture of tissue webs that may be converted into rolled products having improved physical properties, the fabrics are also useful for imparting the web with a relatively basic, yet visually appealing pattern. Without being bound by any particular theory, it is believed that by using a fabric having a relatively small degree of its surface area printed with CD oriented protuberances, the physical benefits of the CD elements imparted to the finished product are achieved without an excessive amount of pattern that may obscure the background pattern imparted by the MD oriented protuberances or interfere with embossing patterns subsequently applied to the web.

Accordingly, the inventive papermaking fabrics are well suited to the manufacture of a wide range of tissue products, such as both tissue and towel products, as well as single and multi-ply products and both embossed and unembossed products. Moreover, the tissue products produced using the inventive fabrics have several unique properties, such as an air side having discrete valleys and discrete CD oriented elements, and physical properties that are comparable or better than those of the prior art.

For instance, tissue webs may have increased bulk and reduced stiffness compared to prior art webs. Similarly, rolled products prepared according to the present disclosure may have improved roll firmness and bulk, while still maintaining sheet softness and strength properties.

For example, the present invention provides towel products having relatively high sheet caliper with a textured air side of the sheet comprising MD and CD oriented elements and discontinuous valleys. These improvements translate into rolled products having desirable physical attributes, as summarized in the table below.

TABLE 1

| | Plies | Embossed | Basis Weight (gsm) | Caliper (microns) | Sheet Bulk (cc/g) | GMT (g/3") | MD Stretch (%) | Firmness (mm) | Roll Bulk (cc/g) | Roll Structure |
|---|---|---|---|---|---|---|---|---|---|---|
| Inventive 1 | 1 | N | 36 | 698 | 19.6 | 2079 | 18.9 | 6.9 | 17.8 | 1.80 |
| Inventive 2 | 1 | N | 36 | 691 | 19.2 | 1974 | 18.7 | 6.7 | 17.7 | 1.83 |
| Inventive 3 | 1 | N | 36 | 706 | 19.9 | 2200 | 17.8 | 6.6 | 17.9 | 1.91 |
| Inventive 4 | 2 | Y | 54 | 1072 | 19.9 | 3207 | 15.7 | 6.6 | 17.8 | 2.89 |
| Inventive 5 | 2 | Y | 52 | 963 | 18.5 | 3209 | 16.4 | 7 | 18.5 | 2.55 |
| Inventive 6 | 2 | Y | 52 | 1095 | 21 | 3204 | 15.9 | 6.1 | 18.4 | 3.30 |
| Viva | 1 | N | 58.4 | 742 | 12.7 | 1416 | 41.2 | 4.3 | 10.8 | 1.86 |

TABLE 1-continued

| | Plies | Embossed | Basis Weight (gsm) | Caliper (microns) | Sheet Bulk (cc/g) | GMT (g/3") | MD Stretch (%) | Firmness (mm) | Roll Bulk (cc/g) | Roll Structure |
|---|---|---|---|---|---|---|---|---|---|---|
| Viva Vantage | 1 | N | 54.3 | 945 | 17.4 | 2443 | 48.9 | 6.3 | 14.3 | 2.14 |
| Scott Towel | 1 | N | 35.6 | 822 | 23.1 | 2432 | 16.3 | 6.9 | 20 | 2.38 |
| Scott Towel | 1 | N | 35.2 | 806 | 22.9 | 2438 | 16.3 | 6.9 | 19.8 | 2.31 |
| Bounty | 2 | Y | 50.4 | 988 | 19.6 | 3428 | 11.2 | 6 | 18.7 | 3.08 |
| Brawny | 2 | Y | 52 | 837 | 16.1 | 3149 | 10.9 | 6.9 | 15.7 | 1.90 |
| Sparkle | 2 | Y | 47.4 | 725 | 15.3 | 3795 | 11.7 | 8.8 | 16.3 | 1.34 |

In other instances the present invention provides bath tissue products having good sheet caliper and bulk with a textured air side of the sheet comprising MD and CD oriented elements and discontinuous valleys. When spirally wound into a roll, the resulting products have desirable physical attributes, as summarized in the table below.

TABLE 2

| | Plies | Embossed | Basis Weight (gsm) | Caliper (microns) | Sheet Bulk (cc/g) | GMT (g/3") | MD Stretch (%) | Firmness (mm) | Roll Bulk (cc/g) | Roll Structure |
|---|---|---|---|---|---|---|---|---|---|---|
| Inventive 1 | 1 | N | 32.2 | 505 | 12.7 | 655 | 17.4 | 6.3 | 12.73 | 1.02 |
| Inventive 2 | 1 | N | 33.3 | 475 | 12.4 | 662 | 19.0 | 6.1 | 12.34 | 0.96 |
| Scott Extra Soft | 1 | N | 28.3 | 386 | 13.6 | 756 | 11.4 | 7.2 | 12.0 | 0.96 |
| Angle Soft | 2 | Y | 37.7 | 391 | 10.4 | 758 | 19.8 | 8.9 | 9.2 | 1.26 |
| Charmin Essentials Soft | 1 | Y | 33.3 | 447 | 13.4 | 962 | 22.3 | 5.7 | 13.5 | 0.78 |
| Charmin Essentials Strong | 1 | Y | 27.9 | 312 | 11.2 | 1117 | 27.1 | 4.1 | 9.8 | 2.28 |
| Cottonelle Clean Care | 1 | N | 38.5 | 483 | 12.5 | 1101 | 16.2 | 8.4 | 12.6 | 2.67 |
| Charmin Ultra Strong | 2 | Y | 37.4 | 462 | 12.4 | 1224 | 14.9 | 7.7 | 12.8 | 1.65 |
| Quilted Northern Ultra Strong | 2 | Y | 42.6 | 490 | 11.5 | 1286 | 27.3 | 7.9 | 11.7 | 2.03 |
| Cottonelle Ultra Comfort Care | 2 | Y | 44.4 | 610 | 13.7 | 990 | 13.2 | 7.5 | 12.9 | 1.90 |

Accordingly, in certain embodiments, rolled products made according to the present disclosure may comprise a spirally wound tissue web having a roll firmness greater than about 6.0 mm, more preferably greater than about 6.5 mm and still more preferably greater than about 7.0 mm, such as from about 6.0 to about 8.0 mm. Within the above-roll firmness ranges, rolls made according to the present disclosure do not appear to be overly soft and "mushy" as may be undesirable by some consumers during some applications.

In the past, at the above-roll firmness levels, spirally wound tissue products had a tendency to have low roll bulks and/or poor sheet softness properties. However, it has now been discovered that spirally wound tissue products having roll bulks of at least about 12 cc/g, such as from about 12 to about 18 cc/g, and more preferably from about 12 to about 15 cc/g may be produced, even when spirally wound under tension to produce relatively firm rolls, such as rolls having a roll firmness greater than about 6.0 mm, more preferably greater than about 6.5 mm and still more preferably greater than about 7.0 mm, such as from about 6.0 to about 8.0 mm.

Test Methods

Tensile

The following test methods are to be conducted on samples that have been in a TAPPI conditioned room at a temperature of 73.4±3.6° F. (about 23±2° C.) and relative humidity of 50±5 percent for 4 hours prior to the test.

Tensile testing was done in accordance with TAPPI test method T-576 "Tensile properties of towel and tissue products (using constant rate of elongation)" wherein the testing is conducted on a tensile testing machine maintaining a constant rate of elongation and the width of each specimen tested is 3 inches. More specifically, samples for dry tensile strength testing were prepared by cutting a 3±0.05 inches (76.2 mm±1.3 mm) wide strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full scale value. The gauge length between jaws was 4±0.04 inches (101.6±1 mm) for facial tissue and towels and 2±0.02 inches (50.8±0.5 mm) for bath tissue. The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on the direction of the sample being tested. Ten representative specimens were tested for each product or sheet and the arithmetic average of all individual specimen tests was recorded as the appropriate MD or CD tensile strength of the product or sheet in units of grams of force per 3 inches of sample. The geometric mean tensile (GMT) strength was calculated and is expressed as grams-force per 3 inches of sample width. Tensile energy absorbed (TEA) and slope are also calculated by the tensile tester. TEA is reported in units of gm·cm/cm$^2$. Slope is recorded in units of grams (g) or kilograms (kg). Both TEA and Slope are directionally dependent and thus MD and CD directions are measured independently. Geometric mean TEA and geometric mean slope are defined as the square root of the product of the representative MD and CD values for the given sample.

Image Analysis

Tissue products and papermaking fabrics produced according to the present invention may be analyzed by microscopy as described herein. Both three-dimensional and two-dimensional images may be collected and analyzed.

Three-dimensional surface topography may be analyzed by generating and analyzing 3D surface maps and cross-sections, such as those illustrated in FIGS. 5A and 5B. The images are taken using a VHX-5000 Digital Microscope manufactured by Keyence Corporation of Osaka, Japan. The microscope is equipped with VHX-5000 Communication Software Ver 1.5.1.1. The lens is an ultra-small, high performance zoom lens, VH-Z20R/Z20T. Samples to be analyzed should be undamaged, flat, and include representative CD and MD oriented elements or protuberances. A sample approximately 4 inches×4 inches in size works well.

A three-dimensional image of the sample is obtained as follows:

1. Turn the digital microscope on, and follow standard procedures for XY stage Initialization [Auto]

2. Turn the microscope magnification to the desired magnification—100× for tissue sheet samples or 20× for papermaking fabrics.

3. Place the sample on the stage with the elements or protuberances facing up toward the lens.

4. If the sample does not lie flat, place weights as needed along the perimeter to make sample lie flat against the stage surface.

5. Use the focus adjustment to bring the sample into sharp focus.

6. Select "Stitching" in the main menu. Select "3D stitching."

7. Set the stitching method by selecting "Stitch around the current position."

8. Select the Z set to set the upper and lower composition range. The upper limit should be set by going higher than the highest focal point that is clear. The lower limit should be set by going lower than the lowest focal point that is clear. After setting the upper and lower range, click OK.

9. Select "Start stitching," to begin acquisition of the image.

10. Select "complete" when the desired area has been imaged, then "Confirm stitching results."

11. In the 3D menu, select "Height/Color view" to identify elements or protuberances to measure.

12. In the 3D menu, select "Profile."

13. With the "Profile line" tab selected obtain a cross-section of the sample identified in Step 11, select "Line" and using the cursor draw a line across the identified portion of the sample. The line should bisect at least two adjacent elements or protuberances. The peaks on the right and left side of the first element or protuberance should be relatively planar (difference in height less than 10 percent).

14. The height of the element or protuberance may then be measured using the VHX-5000 Communication Software Ver 1.5.1.1 by selecting the "Pt-Pt" vertical measurement tool to measure the element or protuberance peak height. If the height difference between the peaks is more than 10 percent select another first element or protuberance to measure. Typically the element or protuberance peak height was measured for three different peaks and the average of the three measurements was reported.

Two dimensional, in-plane measurements of tissue products may be made as follows:

1. Turn the digital microscope on, and follow standard procedures for XY stage Initialization [Auto]

2. Turn the microscope magnification to the desired magnification—100× for tissue sheet samples or 20× for papermaking fabrics.

3. Place the sample on the stage with the elements or protuberances facing up toward the lens.

4. If the sample does not lie flat, place weights as needed along the perimeter to make sample lie flat against the stage surface.

5. Use the focus adjustment to bring the sample into sharp focus.

6. Select "Stitching" in the main menu. Select "2D stitching."

7. Set the stitching method by selecting "Stitch around the current position."

8. Select the Z set to set the upper and lower composition range. The upper limit should be set by going higher than the highest focal point that is clear. The lower limit should be set by going lower than the lowest focal point that is clear. After setting the upper and lower range, click OK.

9. Select "Start stitching," to begin acquisition of the image.

10. Select "complete" when the desired area has been imaged, then "Confirm stitching results."

11. Select "Complete (show stitched image)."

12. From the tool bar select "Measure."

13. Select "Plane measurement," select the appropriate measurement tool and perform the desired measurement.

Typically the dimensions of an element or protuberance, such as the length of a CD oriented protuberance disposed on a papermaking fabric, were determined for three elements or protuberances and the average of the three measurements was reported.

The element angle of a protuberance or an element was measured using the VHX-5000 Communication Software Ver 1.5.1.1 by obtaining a 2-D image as described above and then, using the plane measurement tool, a reference line was drawn perpendicular to the machine direction axis of the fabric. A second line was drawn substantially along the element axis. The image analysis software was then used to determine the angle between the first and second lines. The angle of three elements or protuberances was obtained and the average of the three measurements was recorded as the element angle.

The surface area of a papermaking fabric covered by protuberances may also be measured using the VHX-5000 Communication Software Ver 1.5.1.1. An image of the fabric was acquired at a magnification of 20× and from the on-screen menu "Measure" was selected, followed by selection of "Auto" area measurement, then the "Color" option was selected and a measurement was taken. Once a measurement was taken the structuring elements were filled using the "Fill" and "Eliminate Small Grains" features, followed by selecting a Shaping step. If there are areas of the structuring elements that needed to be filled in, or otherwise edited to create an accurate 2-D highlight of the structuring elements, an accurate area representation was created by selecting "Edit", "Fill." The results were than tabulated by selecting "Next" to proceed to the Result Display step where "Measure Result" was selected and the calculated Area Ratio Percent was displayed. The measurement was repeated for three distinct areas of the fabric sample and an arithmetic average Area Ratio Percent of the measurements was reported.

Profilometry

The valley depth and angle, as well as other fabric properties, are measured using a non-contact profilometer as described herein. To prevent any debris from affecting the measurements, all images are subjected to thresholding to remove the top and bottom 0.5 mm of the scan. To fill any holes resulting from the thresholding step and provide a continuous surface on which to perform measurements, non-measured points are filled. The image is also flattened by applying a rightness filter.

Profilometry scans of the fabric contacting surface of a fabric sample were created using an FRT MicroSpy® Profile profilometer (FRT of America, LLC, San Jose, Calif.) and then analyzing the image using Nanovea® Ultra software version 7.4 (Nanovea Inc., Irvine, Calif.). Samples were cut into squares measuring 145×145 mm. The samples were then secured to the x-y stage of the profilometer using an aluminum plate having a machined center hole measuring 2×2 inches, with the fabric contacting surface of the sample facing upwards, being sure that the samples were laid flat on the stage and not distorted within the profilometer field of view.

Once the sample was secured to the stage the profilometer was used to generate a three-dimensional height map of the sample surface. A 1602×1602 array of height values were obtained with a 30 μm spacing resulting in a 48 mm MD×48 mm CD field of view having a vertical resolution 100 nm and a lateral resolution 6 um. The resulting height map was exported to .sdf (surface data file) format.

Individual sample .sdf files were analyzed using Nanovea® Ultra version 7.4 by performing the following functions:

(1) Using the "Thresholding" function of the Nanovea® Ultra software the raw image (also referred to as the field) is subjected to thresholding by setting the material ratio values at 0.5 to 99.5 percent such that thresholding truncates the measured heights to between the 0.5 percentile height and the 99.5 percentile height; and (2) Using the "Fill In Non-Measured Points" function of the Nanovea® Ultra software the non-measured points are filled by a smooth shape calculated from neighboring points.

(3) Using "Filtering>Wavyness+Roughness" function of the Nanovea® Ultra software the field is spatially low pass filtered (waviness) by applying a Robust Gaussian Filter with a cutoff wavelength of 0.095 mm and selecting "manage end effects";

(4) Using the "Filtering−Wavyness+Roughness" function of the Nanovea® Ultra software the field is spatially high pass filtered (roughness) using a Robust Gaussian Filter with a cutoff wavelength of 0.5 mm and selecting "manage end effects";

(6) Using the "Abbott-Firestone Curve" study function of the Nanovea® Ultra software an Abbott-Firestone Curve is generated from which "interactive mode" is selected and a histogram of the measured heights is generated, from the histogram an S90 value (95 percentile height (C2) minus the 5 percentile height (C1), expressed in units of mm) is calculated.

The foregoing yields three values indicative of the fabric topography—valley depth, valley width and wall angle. Valley width is the Psm value having units of millimeters (mm). Valley depth is the difference between C2 and C1 values, also referred to as S90, having units of millimeters (mm). Valley angle is the Pdq value having units of degrees (°). Generally wall angle and valley width are measured along a line drawn normal to the machine direction axis of the fabric, where the line intersects at least two adjacent MD oriented protuberances.

Before measuring element angle, care must be taken to ensure that fabric is properly oriented before the surface map obtained by the FRT MicroSpy profilometer, as described above. To ensure that the warp filaments are aligned with the MD axis of the fabric and the shute filaments aligned with the CD axis, a shute filament from the bottom of the fabric can be pulled by hand completely across the CD of the fabric to create a single shute filament aligned with the fabric CD axis. The single shute filament may then be used as a guide to align the fabric on the profilometer stage and a profilometer scan of the fabric may be obtained as described above.

Once a scan of the fabric is completed and the .sdf is analyzed as described above, the element angle is determined using the "texture direction" function under the "Studies" tab of the Nanovea® Ultra software. Once the "texture direction" is selected, the angle of the three most elevated features on the fabric surface will be reported. To calculate the element angle, the value for the protuberance of interest is selected and subtracted from 90 degrees. The resulting value is the element angle, having units of degrees.

EXAMPLES

Example 1—Single Ply UCTAD Bath Tissue

Tissue webs were made using a through-air dried papermaking process commonly referred to as "uncreped through-air dried" ("UCTAD") as generally described in U.S. Pat. No. 5,607,551. Base sheets with a target bone dry basis weight ranging of about 34 grams per square meter (gsm) were produced. The base sheets were then converted and spirally wound into rolled tissue products as described below.

In all cases the base sheets were produced from a furnish comprising northern softwood kraft (NSWK) and *eucalyptus* kraft (EHWK) using a layered headbox to produce a tissue web having three layer (two outer layers and a middle layer) were formed. The two outer layers comprised EHWK (each layer comprising 30 wt %) and the middle layer comprised 25 wt % NSWK and 15 wt % EHWK. Strength was controlled via the addition of starch and/or by refining the NSWK furnish.

The tissue web was formed on a TissueForm V forming fabric, vacuum dewatered to approximately 25 percent consistency and then subjected to rush transfer when transferred to the transfer fabric at a rush transfer rate of about 28 percent. The transfer fabric was the fabric described as "Fred" in U.S. Pat. No. 7,611,607 (commercially available from Voith Fabrics, Appleton, Wis.). The web was then transferred to a through-air drying fabric using vacuum levels of at least about 10 inches of mercury and dried to approximately 98 percent solids before winding. For each of the experimental codes the through-air drying fabric comprised a woven base fabric, a t-1205-2 woven fabric (commercially available from Voith Fabrics, Appleton, Wis. and previously described in U.S. Pat. No. 8,500,955) having a silicone pattern printed on the web contacting surface. Details of the silicone pattern printed on the each of the fabrics is provided in Table 3, below.

TABLE 3

| Code | Printed Nonwoven Elements | Nonwoven Element Pattern | Pattern Percent Surface Coverage |
|---|---|---|---|
| 1 | Y | FIG. 5A | 7.5% |
| 2, 3 | Y | FIG. 5B | 3.75% |
| 4 | Y | FIG. 2 U.S. Pat. No. 8,940,376 | 17.95% |

The base sheet webs were converted into various bath tissue rolls. Specifically, base sheet was calendered using a single conventional polyurethane/steel calenders comprising a 40 P&J polyurethane roll on the aft side of the sheet and a standard steel roll on the fabric side. The calender load was 50 pli. The calendered sheet was then spirally wound about a core. All rolled products comprised a single ply of base sheet. The finished products were conditioned and the physical properties tested. The results of the physical testing are summarized in Table 4 and 5, below.

TABLE 4

| Code | Basis Weight (gsm) | Caliper (microns) | Sheet Bulk (cc/g) | Firmness (mm) | Roll Bulk (cc/g) | Roll Structure |
|---|---|---|---|---|---|---|
| 1 | 32.2 | 505 | 12.73 | 6.3 | 12.73 | 1.02 |
| 2 | 28.5 | 431 | 13.30 | 6.3 | 11.46 | 0.78 |
| 3 | 28.2 | 439 | 13.30 | 6.0 | 11.79 | 0.86 |
| 4 | 33.2 | 475 | 12.36 | 6.1 | 12.34 | 0.96 |

TABLE 5

| Code | GMT (g/3") | Tensile Ratio | MD Stretch (%) | GM TEA | GM Slope (g) | Stiffness Index |
|---|---|---|---|---|---|---|
| 1 | 655 | 2.06 | 17.4 | 5.35 | 5149 | 7.87 |
| 2 | 746 | 2.24 | 12.0 | 6.72 | 5066 | 6.79 |
| 3 | 758 | 2.23 | 11.4 | 6.05 | 5126 | 6.76 |
| 4 | 662 | 2.07 | 19.0 | 5.85 | 4250 | 6.79 |

Codes 2 and 3, which represent one embodiment of the present invention, were analyzed by microscopy as described herein. The codes generally had a discrete CD elements have a length of about 7 mm and had an element angle of about 35 degrees. The product comprised discrete valleys having a maximum length of about 26 mm. Further, the CD elements had a height of about 375 μm and the MD elements had a height of about 350 μm.

Example 2—Single Ply UCTAD Towel

Base sheets were prepared substantially as described in Example 1, except that the target base sheet basis weight was 38 gsm and the two outer layers comprised EHWK (each layer comprising 30 wt %) and the middle layer comprised 40 wt % NSWK. Strength was controlled via the addition of CMC, Kymene and/or by refining the NSWK furnish of the center layer.

For each of the experimental codes the through-air drying fabric comprised a woven base fabric, a t-1205-2 woven fabric (commercially available from Voith Fabrics, Appleton, Wis. and previously described in U.S. Pat. No. 8,500,955) having a silicone pattern printed on the web contacting surface. Details of the silicone pattern printed on the each of the fabrics is provided in Table 6, below.

TABLE 6

| Code | Printed Nonwoven Elements | Nonwoven Element Pattern | Pattern Percent Surface Coverage |
|---|---|---|---|
| 5 | Y | FIG. 5A | 7.5% |
| 6 | Y | FIG. 5B | 3.75% |
| 7 | Y | FIG. 2 U.S. Pat. No. 8,940,376 | 17.95% |

The base sheet webs were converted into various bath tissue rots. Specifically, base sheet was calendered using a single conventional polyurethane/steel calenders comprising a 40 P&J polyurethane rot on the air side of the sheet and a standard steel roll on the fabric side. The calender load was 50 pli. The calendered sheet was then spirally wound about a core. All rolled products comprised a single ply of base sheet. The finished products were conditioned and the physical properties tested. The results of the physical testing are summarized in Tables 7 and 8, below.

TABLE 7

| Code | Basis Weight (gsm) | Caliper (microns) | Sheet Bulk (cc/g) | Firmness (mm) | Roll Bulk (cc/g) | Roll Structure |
|---|---|---|---|---|---|---|
| 5 | 36.0 | 691 | 19.2 | 6.74 | 17.85 | 1.81 |
| 6 | 35.6 | 698 | 19.6 | 6.88 | 17.67 | 1.81 |
| 7 | 34.4 | 701 | 20.4 | 6.84 | 18.47 | 1.89 |

TABLE 8

| Code | GMT (g/3") | Tensile Ratio | MD Stretch (%) | GM TEA | GM Slope (g) | Stiffness Index |
|---|---|---|---|---|---|---|
| 5 | 1974 | 1.13 | 18.9 | 16.19 | 8070 | 4.09 |
| 6 | 2079 | 1.26 | 18.7 | 16.64 | 8288 | 3.99 |
| 7 | 2210 | 1.43 | 18.2 | 17.21 | 10275 | 4.65 |

Code 6, which represent one embodiment of the present invention, was analyzed by microscopy as described herein. Images of the inventive code are shown in FIGS. 6-9. The code generally had discrete CD elements having a length of about 7 mm and an element angle of about 35 degrees. The product comprised discrete valleys having a maximum length of about 26 mm. Further, the CD elements had a height of about 800 μm and the MD elements had a height of about 650 μm.

Example 3—Multi-Ply UCTAD Towel

Base sheets were prepared substantially as described in Example 1, except that the target base sheet basis weight was about 27 grams per square meter (gsm). In all cases the base sheets were produced from a furnish comprising northern softwood kraft (NSWK) and *eucalyptus* hardwood kraft (EHWK) using a layered headbox to produce a tissue web having three layers (two outer layers and a middle layer)

were formed. The two outer layers comprised EHWK (each layer comprising 20 wt % of the tissue web) and the middle layer comprised NSWK (middle layer comprised 60 wt % of the tissue web). Strength was controlled via the addition of carboxymethylcellulose (CMC) and a permanent wet strength resin, and/or by refining the NSWK furnish.

For each of the experimental codes the through-air drying fabric comprised a woven base fabric, a t-1205-2 woven fabric (commercially available from Voith Fabrics, Appleton, Wis. and previously described in U.S. Pat. No. 8,500,955) having a silicone pattern printed on the web contacting surface. Details of the silicone pattern printed on the each of the fabrics is provided in Table 9, below.

TABLE 9

| Code | Printed Nonwoven Elements | Nonwoven Element Pattern | Pattern Percent Surface Coverage |
|---|---|---|---|
| 8 | Y | FIG. 5A | 7.5% |
| 9 | Y | FIG. 5B | 3.75% |
| 10 | Y | FIG. 2 U.S. Pat. No. 8,940,376 | 17.95% |

The base sheet, prepared as described above, was converted into a two-ply rolled towel product. Specifically, the base sheet was calendered using a patterned steel roll and a 40 P&J polyurethane roll at a load of 30 pli. The calendered base sheet was then converted to a two-ply product by embossing and laminating substantially as described in co-pending International Application No. PCT/US18/58322 and illustrated in FIG. 1A thereof. The engraved roll had a chevron-like pattern that provided the product with an embossed area of about 7 percent. The two-ply tissue product was then converted into a rolled towel product and subjected to physical testing, the results of which are shown in Tables 10 and 11, below.

TABLE 10

| Code | Basis Weight (gsm) | Caliper (microns) | Sheet Bulk (cc/g) | Firmness (mm) | Roll Bulk (cc/g) | Roll Structure |
|---|---|---|---|---|---|---|
| 8 | 52.0 | 963 | 18.5 | 7.0 | 18.45 | 2.53 |
| 9 | 54.0 | 1072 | 19.9 | 6.6 | 17.77 | 2.89 |
| 10 | 53.3 | 988 | 18.5 | 6.8 | 18.01 | 2.60 |

TABLE 11

| Code | GMT (g/3") | Tensile Ratio | MD Stretch (%) | GM TEA | GM Slope (g) | Stiffness Index |
|---|---|---|---|---|---|---|
| 8 | 3208 | 1.26 | 16.4 | 26.01 | 12349 | 3.85 |
| 9 | 1974 | 1.13 | 16.4 | 16.64 | 8288 | 3.99 |
| 10 | 3131 | 1.19 | 15.5 | 22.32 | 12636 | 4.04 |

Embodiments

In a first embodiment the present invention provides a rolled bath tissue product comprising a spirally wound singly-ply tissue sheet having a fabric side and an opposite air contacting side and a machine direction (MD) and a cross-machine direction (CD), the sheet having a basis weight from 10 to 50 gsm and a geometric mean tensile (GMT) strength less than about 1,000 g/3", wherein the air contacting side comprises a plurality of discrete valleys having a length greater than about 10 mm.

In a second embodiment the present invention provides the product of the first embodiment further comprising a plurality of substantially continuous MD oriented elements spaced apart from one another in the CD.

In a third embodiment the present invention provides the product of the first or the second embodiments further comprising a plurality of discrete CD oriented elements spaced apart from one another in the MD.

In a fourth embodiment the present invention provides the product of any of the first through third embodiments wherein the plurality of discrete valleys have first and second sidewalls formed from a first and a second MD oriented element and first and second endwalls formed from a first and a second CD oriented element.

In a fifth embodiment the present invention provides the product of any of the first through fourth embodiments wherein the plurality of MD oriented elements are substantially parallel to one another and have an element angle from about 0.5 to about 10 degrees.

In a sixth embodiment the present invention provides the product of any of the first through fifth embodiments wherein the plurality of CD oriented elements are substantially parallel to one another and have an element angle from about 20 to about 40 degrees.

In a seventh embodiment the present invention provides the product of any of the first through sixth embodiments wherein the plurality of CD oriented elements have a length from about 3.0 to about 10.0 mm.

In an eighth embodiment the present invention provides the product of any of the first through seventh embodiments wherein the plurality of CD oriented elements have a height from about 300 to about 500 μm.

In an ninth embodiment the present invention provides the product of any of the first through eighth embodiments wherein the discrete valleys have a length from about 10 to about 30 mm and a width from about 1.0 to about 3.0 mm.

In a tenth embodiment the present invention provides the product of any of the first through ninth embodiments having a caliper greater than about 400 μm and a roll structure greater than about 0.75, or a roll bulk greater than about 11 cc/g and a roll structure greater than about 0.75, or a firmness from about 6.0 to about 8.0 and a roll structure greater than about 0.75, or a geometric mean tensile (GMT) from about 500 to about 800 g/3" and a Stiffness Index less than about 8.0.

What is claimed is:

1. A rolled bath tissue product comprising a spirally wound singly-ply tissue sheet having a fabric side and an opposite air contacting side and a machine direction (MD) and a cross-machine direction (CD), a plurality of MD oriented elements spaced apart from one another in the CD and a plurality of discrete CD oriented elements apart from one another in the MD and having a length from 3.0 to 10.0 mm, the MD and CD oriented elements arranged to form discrete valleys having a length greater than 10 mm therebetween, the sheet having a basis weight from 10 to 50 gsm and a geometric mean tensile (GMT) strength less than 1,000 g/3".

2. The rolled bath tissue product of claim 1 wherein the plurality of MD oriented elements are substantially continuous.

3. The rolled bath tissue product of claim 2 wherein the plurality of MD oriented elements are substantially parallel to one another and have an element angle from 0.5 to 10 degrees.

4. The rolled bath tissue product of claim 1 wherein the plurality of discrete valleys have first and second sidewalls formed from a first and a second MD oriented element and first and second endwalls formed from a first and a second CD oriented element.

5. The rolled bath tissue product of claim 1 wherein the plurality of CD oriented elements are substantially parallel to one another and have an element angle from 20 to 40 degrees.

6. The rolled bath tissue product of claim 1 wherein the plurality of CD oriented elements have a height from 300 to 500 μm.

7. The rolled bath tissue product of claim 1 wherein the discrete valleys have a length from 10 to 30 mm and a width from 1.0 to 3.0 mm.

8. The rolled bath tissue product of claim 1 having a caliper greater than 400 μm and a roll structure greater than 0.75.

9. The rolled bath tissue product of claim 1 having a roll bulk greater than 11 cc/g and a roll structure greater than 0.75.

10. The rolled bath tissue product of claim 1 having a firmness from 6.0 to 8.0 and a roll structure greater than 0.75.

11. The rolled bath tissue product of claim 1 having a geometric mean tensile (GMT) from 500 to 800 g/3" and a Stiffness Index less than 8.0.

12. A tissue sheet having an air side and an opposite fabric side, wherein the air side comprises discrete CD oriented elements having an element angle from 20 to 45 degrees and extending between spaced apart substantially continuous MD oriented elements, the discrete CD oriented elements and continuous MD oriented elements spaced apart from one another and arranged to form discrete valleys having a length from 10 to 30 mm therebetween, the tissue sheet having a basis weight from 10 to 50 gsm and a geometric mean tensile (GMT) strength less than 1,000 g/3".

13. The tissue sheet of claim 12 further comprising a plurality of discrete valleys having valley sidewalls defined by the spaced apart substantially continuous MD oriented elements and valley endwalls defined by discrete CD oriented elements.

14. The tissue sheet of claim 12 wherein the substantially continuous MD oriented elements are substantially parallel to one another and have an element angle from 0.5 to 10 degrees and the discrete CD oriented elements have an element angle from 20 to 40 degrees.

15. The tissue sheet of claim 12 wherein the discrete CD oriented elements have a height from 300 to 500 μm.

16. A tissue product having a three-dimensional surface topography comprising a plurality of substantially continuous MD oriented elements, a plurality of discrete CD oriented elements having a length from 3.0 to 10.0 mm, and a plurality of discrete MD oriented valleys having valley sidewalls formed by the MD oriented elements and valley endwalls formed by the CD oriented elements and a length greater than 10.0 mm, wherein the tissue product has a basis weight greater than 25 gsm and a GMT less than 1,000 g/3".

17. The tissue product of claim 16 wherein the discrete CD oriented elements have an element angle from 25 to 35 degrees.

* * * * *